US008322802B2

(12) United States Patent
Boxenbaum et al.

(10) Patent No.: US 8,322,802 B2
(45) Date of Patent: Dec. 4, 2012

(54) OFFICE FURNITURE SYSTEM

(76) Inventors: Charles H Boxenbaum, Brooklyn, NY (US); Julian L. Boxenbaum, New York, NY (US)

( * ) Notice: Subject to any disclaimer, the term of this patent is extended or adjusted under 35 U.S.C. 154(b) by 1080 days.

(21) Appl. No.: 11/562,000

(22) Filed: Nov. 21, 2006

(65) Prior Publication Data

US 2007/0114892 A1 May 24, 2007

Related U.S. Application Data

(60) Provisional application No. 60/738,813, filed on Nov. 22, 2005.

(51) Int. Cl.
*A47B 47/00* (2006.01)

(52) U.S. Cl. ..... 312/223.3; 312/194

(58) Field of Classification Search ..... 108/50.01, 108/50.02, 155, 26, 25, 27, 60, 65, 69, 185, 108/187; 312/194–196, 223.3, 223.6, 312, 312/208.1, 23, 107; 52/36.1
See application file for complete search history.

(56) References Cited

U.S. PATENT DOCUMENTS 1,826,469 A * 10/1931 Hunt et al. ..... 40/533
1,958,579 A * 5/1934 Johnson et al. ..... 434/414
2,555,776 A 6/1951 Alschuler et al.
2,875,012 A * 2/1959 Riley ..... 312/312
3,083,417 A * 4/1963 Cook ..... 52/64
3,245,741 A * 4/1966 Bartlett ..... 312/312
3,883,202 A 5/1975 Konig
4,224,769 A * 9/1980 Ball et al. ..... 52/36.1
4,323,291 A 4/1982 Ball
4,612,863 A * 9/1986 Vonhausen et al. ..... 108/28
4,639,049 A * 1/1987 Frascaroli et al. ..... 312/195
4,735,467 A 4/1988 Wolters et al.
4,766,422 A 8/1988 Wolters et al.
4,792,881 A 12/1988 Wilson et al.
4,836,481 A * 6/1989 Ceccarelli ..... 248/188.1
4,836,623 A * 6/1989 Holland ..... 312/195
4,852,500 A 8/1989 Ryburg et al.
4,932,332 A 6/1990 Noda
4,946,121 A 8/1990 Troke
5,024,167 A * 6/1991 Hayward ..... 108/50.02
5,071,204 A 12/1991 Price et al.
5,125,727 A 6/1992 Lechman et al.
5,213,302 A 5/1993 Rowe, Jr.
5,255,966 A 10/1993 Newhouse et al.
5,362,923 A 11/1994 Newhouse et al.
5,410,972 A 5/1995 Schairbaum
5,655,822 A 8/1997 Roberts et al.
5,694,862 A 12/1997 Grubb
5,732,924 A 3/1998 Hegarty et al.
5,833,332 A 11/1998 Marshall et al.
5,878,673 A 3/1999 Kramer et al.
5,897,179 A * 4/1999 Wade ..... 312/223.6
(Continued)

FOREIGN PATENT DOCUMENTS

DE 3603465 8/1987
(Continued)

*Primary Examiner* — Janet M Wilkens

(57) ABSTRACT

Office furniture system, in particular, a desking system, with various useful features including a display pool, a vertical storage system, a support system for facilitating the distribution of power and data to electrical devices used with the desk system as well to adjacently disposed desks to enable a wide range of multi-desk configurations, and privacy panels. The support system includes a central spine and various ribs for supporting accessory brackets including a tackable binder.

6 Claims, 16 Drawing Sheets

U.S. PATENT DOCUMENTS

| | | | | |
|---|---|---|---|---|
| 5,899,025 | A | 5/1999 | Casey et al. | |
| 6,033,045 | A | 3/2000 | Roberts et al. | |
| 6,092,883 | A * | 7/2000 | Lechman | 312/194 |
| 6,152,553 | A | 11/2000 | Wunderlich | |
| 6,170,926 | B1 | 1/2001 | Roberts et al. | |
| 6,180,884 | B1 | 1/2001 | Tokunaga et al. | |
| 6,202,567 | B1 * | 3/2001 | Funk et al. | 108/50.02 |
| 6,254,206 | B1 | 7/2001 | Petrick et al. | |
| 6,283,043 | B1 | 9/2001 | Stern et al. | |
| 6,283,564 | B1 | 9/2001 | Corson | |
| 6,327,983 | B1 * | 12/2001 | Cronk et al. | 108/50.02 |
| 6,398,178 | B1 | 6/2002 | Azola et al. | |
| 6,412,889 | B1 | 7/2002 | Hummell et al. | |
| 6,435,106 | B2 | 8/2002 | Funk et al. | |
| 6,453,826 | B1 | 9/2002 | Fookes et al. | |
| 6,601,931 | B1 * | 8/2003 | Schairbaum et al. | 312/194 |
| 6,609,465 | B2 | 8/2003 | Kolavo | |
| 6,612,670 | B2 | 9/2003 | Liu | |
| 6,676,231 | B1 | 1/2004 | Kelley et al. | |
| 6,712,433 | B2 * | 3/2004 | Hellwig et al. | 312/223.6 |
| 6,725,784 | B2 * | 4/2004 | Crinion | 108/64 |
| 6,857,712 | B1 | 2/2005 | Haberman | |
| 6,931,795 | B1 * | 8/2005 | Baloga et al. | 52/36.1 |
| D521,770 | S | 5/2006 | Madison | |
| 7,036,438 | B2 * | 5/2006 | Okamoto et al. | 108/153.1 |
| 7,407,239 | B2 * | 8/2008 | Kunz | 312/312 |
| 2002/0043187 | A1 | 4/2002 | Felton et al. | |
| 2002/0050234 | A1 | 5/2002 | Lechman | |
| 2002/0073902 | A1 | 6/2002 | Jipp | |
| 2003/0006603 | A1 * | 1/2003 | Pontecorvo | 281/31 |
| 2003/0020381 | A1 | 1/2003 | Cattaneo | |
| 2003/0070595 | A1 | 4/2003 | Crinion | |
| 2003/0202317 | A1 | 10/2003 | Jans | |
| 2003/0221797 | A1 | 12/2003 | Schaller, Jr. | |
| 2004/0187401 | A1 | 9/2004 | Krestakos et al. | |
| 2005/0016080 | A1 * | 1/2005 | Williams et al. | 52/36.1 |
| 2005/0263041 | A1 * | 12/2005 | Mueller et al. | 108/50.02 |
| 2005/0268823 | A1 * | 12/2005 | Bakker et al. | 108/50.02 |
| 2005/0279257 | A1 * | 12/2005 | Bettinger | 108/50.02 |
| 2005/0284341 | A1 * | 12/2005 | Klassy et al. | 108/50.02 |
| 2006/0065162 | A1 * | 3/2006 | Chi et al. | 108/7 |
| 2006/0102812 | A1 | 5/2006 | Cvek | |

FOREIGN PATENT DOCUMENTS

| | | | |
|---|---|---|---|
| EP | 0058535 | * | 12/1982 |
| EP | 0236809 | | 9/1987 |
| EP | 898909 | * | 3/1999 |
| EP | 1700538 | * | 9/2006 |
| GB | 2130877 | | 6/1984 |
| GB | 2172197 | | 9/1986 |
| JP | 4-197202 | | 7/1992 |

* cited by examiner 50
58
59
56
53
52
54

OFFICE FURNITURE SYSTEM

REFERENCE TO RELATED APPLICATION

This application claims the benefit of U.S. Provisional Patent Application Ser. No. 60/738,813, filed Nov. 22, 2005, the disclosure of which is incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention is directed to an office furniture system and, more particularly, to a desking system designed for high density layouts and storage that are easily changed and that further allow for individual control of the work environment.

2. Description of the Related Art

A variety of types of office furniture, including desk systems, currently are available. Office furniture comes in a multitude of shapes and sizes, and include various well known features, such as built-in file cabinets, drawers, privacy panels, monitor displays, and so on. In many systems, extra storage is provided by adding drawers, shelves and other mechanical components to the desk system. However, as storage capacity increases, desk size or cabinet size increases. Increased desk size, however, typically is not desirable in the workplace setting, where space equates to cost. Other disadvantages encountered with current designs that seek to maximize space efficiency and functionality include crowding the desk user one way or another, inconveniencing the desk user, and limiting the placement of components, such as computer monitor, lamps, etc., to less than desirable locations. Another disadvantage encountered with current designs is their general difficulty in being reconfigured and moved, which typical requires a desk system to be broken down into its multiple components prior to being reconfigured or moved. Other disadvantages not named herein also are encountered. Hence, there still is considerable demand for desk systems that provide various advantageous features with minimal drawback.

OBJECTS AND SUMMARY OF THE INVENTION

In view of the foregoing, it is an object of the invention to provide an office furniture system that is more space efficient than existing designs.

It is another object of the invention to provide an office furniture system that is more flexible in functionality than existing designs.

It is a further object of the invention to provide an office furniture system that allows for a greater variety of multi-desk configurations than existing designs.

It is yet another object of the invention to provide an office furniture system that enjoys the foregoing advantages as well as other advantages and benefits without the drawbacks experienced with prior and existing systems.

These and other objects are realized by the following summarized embodiments, aspects and features of the office furniture system of the present invention.

In accordance with the present invention, a desk system comprises a primary work surface, a plurality of legs supporting the primary work surface, and a display pool disposed within the primary work surface. The display pool has a transparent window that is substantially flush with a top surface of the primary work surface. The display pool further has a tray disposed beneath the transparent window and is adapted to contain an object for viewing through the transparent window, and the display pool is adapted to enable access by a user of the desk system to the object contained by the tray.

As an aspect of the invention, the tray is hinged to the desk system and adapted to enable access to the tray beneath the primary work surface.

As another aspect of the invention, the tray is adapted to be moved between a first position in which a top surface of the tray is flush with a bottom surface of the transparent window, and a second position in which the top surface of the tray is accessible by a user to place a substantially flat object on the top surface of the tray.

In accordance with another embodiment of the present invention, a desk system comprises a primary work surface having front and rear edges, a plurality of legs supporting the primary work surface, and a longitudinal central spine disposed beneath the primary work surface and substantially at a distance from both the front and rear edges of the primary work surface. The central spine includes a compartment adapted to enable for distribution of power and/or data to at least one electrical device used by a user of the desk system.

As an aspect of this embodiment, the central spine includes upper and lower compartments, the lower compartment includes cable adapted to distribute power and/or data from an end of the primary work surface to an intermediate position along the central spine, and the upper compartment includes an outlet coupled to the cable and adapted to receive a plug of one or more electrical devices.

As another aspect of this embodiment, the central spine includes a dividing wall disposed between the upper and lower compartments and adapted to conceal the lower compartment, the outlet being disposed within the dividing wall.

As a further aspect of this embodiment, the primary work surface includes separate front and rear sections, the central spine being disposed beneath and along a boundary between the front and rear sections of the primary work surface, and the front or rear section of the primary work surface being adapted to be movable away from the other section to enable access to the central spine from above the primary work surface.

As an additional aspect of this embodiment, the primary work surface includes separate front and rear sections, the central spine being disposed beneath and along a boundary between the front and rear sections of the primary work surface, and the front section of the primary work surface being adapted to be slidable toward a front of the desk system to expose the central spine from above the primary work surface to enable access to the central spine from above the primary work surface.

As a feature of this aspect, the central spine includes a plurality of outlets adapted to supply power and/or data to an electrical device.

As a further aspect of the invention, the desk system further includes an accessory bracket having a first end supported within the central spine beneath the primary work surface and a second end extending above the primary work surface, the second end adapted to support an accessory of the desk system.

As an additional aspect of the invention, the central spine is disposed substantially across a mid-section of the primary work surface and the second end of the accessory bracket extends above the primary work surface substantially at the mid-section of the primary work surface.

As yet another aspect of the invention, the central spine extends between two side ends of the desk system and includes a longitudinally extending aperture extending between the two side ends of the desk system, the first end of the accessory bracket being adapted to be supported at a plurality of positions within the aperture of the central spine.

As yet a further aspect of the invention, the central spine extends between two side ends of the desk system and includes a plurality of distinct apertures spaced along the central spine, the first end of the accessory bracket being adapted to be supported within any one of the distinct apertures of the central spine.

As yet an additional aspect of the invention, the central spine includes a first compartment adapted to distribute power and/or data from an end of the primary work surface to one or more intermediate positions along the central spine, and the central spine includes a second compartment adjacent to the first compartment and adapted to receive the first end of the accessory bracket.

As still yet a further aspect of the invention, the central spine extends between two side ends of the desk system and includes a longitudinally extending aperture extending between the two side ends of the desk system, the first end of the accessory bracket being adapted to be supported within and slidable along the aperture within the central spine.

As still yet another aspect of the invention, the desk system includes a tackable binder coupled to the second end of the accessory bracket, the tackable binder having a plurality of pages, each of the pages being adapted to tack to one or more articles.

As a feature of this aspect, each of the pages is made of cork, magnetically attractive material, or whiteboard.

As a further feature of this aspect, the tackable binder is comprised of a base coupled to the second end of the accessory bracket, a longitudinal support extending vertically from the base, and a plurality of rings disposed around the longitudinal support, and each of the pages of tackable material are held by the rings.

As another feature of this aspect, the second end of the accessory bracket is adapted to rotate relative to the first end, the second end rotating between a first position in which the tackable binder is facing a front of the desk system and a second position in which the tackable binder is facing a rear of the desk system.

As a further aspect of the invention, the central spine is part of a support system of the desk system, the support system further having left and right ribs, the central spine extending from substantially a mid-section of the left rib to substantially a mid-section of the right rib, each of the central spine, left rib and right rib adapted to enable for distribution of power and/or data to at least one electrical device used by a user of the respective desk, and the support system is adapted to distribute the power and/or data at an end of the left and/or right ribs to an adjacently disposed desk.

As a feature of this aspect, the support system has a central rib extending from substantially a mid-section of the central spine to the rear edge of the primary work surface, the support system being adapted to distribute the power and/or data at an end of the central rib at the rear edge of the primary work surface to an adjacently disposed desk.

In accordance with another embodiment of the invention, an apparatus comprises a binder, a plurality of pages of tackable material held by the binder, each of the pages being adapted to tack to one or more articles.

As an aspect of this embodiment, each of the pages is made of cork, magnetically attractive material, or whiteboard.

As another aspect of this embodiment, the binder is comprised of a base, a longitudinal support extending vertically from the base, and a plurality of rings disposed around the longitudinal support, and each of the pages of tackable material are held by the rings.

As a feature of this aspect, each of the pages is sufficiently firm to be self-supporting when held by the rings.

As a further feature of this aspect, each of the pages of tackable material is maintained at a respective position around the longitudinal support.

In accordance with a further embodiment of the present invention, a desk system comprises a primary work surface, a plurality of legs supporting the primary work surface, and a storage system disposed substantially fully below and substantially adjacent to a top surface of the primary work surface when in a closed position. The storage system includes an outer cabinet and an inner storage structure, the inner storage structure has a storage area adapted to contain items for storage, the inner storage structure is substantially fully contained within the outer cabinet when in the closed position, the storage area is inaccessible by a user when in the closed position, the inner storage structure is disposed above the outer cabinet when in an open position, the storage area is accessible by a user to access items stored within the storage area when in the open position, and the inner storage structure is adapted to be vertically moved between the closed position and the open position.

As an aspect of this embodiment, the primary work surface includes front and rear sections, and each of the rear section of the primary work surface and the storage system have a width substantially approximately half of a width of the front section, the rear section being disposed behind the right or left side of the front section, and the storage system being disposed behind the other side of the front section.

As another aspect of this embodiment, a top surface of the storage system when in the closed position is substantially flush with a top surface of the rear section of the primary work surface.

As a further aspect of this embodiment, an amount of volumetric space relative to a user of the desk system when the storage system is in the closed position is substantially equal to an amount of volumetric space relative to the user of the desk system when the storage system is in the open position.

As an additional aspect of this embodiment, the inner storage structure is substantially fully disposed above the outer cabinet when in the open position, the storage area being substantially fully accessible by the user when in the open position.

As yet another aspect of this embodiment, the storage area is comprised of upper and lower storage areas, the upper storage area being accessible and the lower storage area being inaccessible when the storage system is in a partially open position.

As yet a further aspect of this embodiment, the desk system comprises a frame supporting the primary work surface, and the outer cabinet of the storage system is fixed to the frame.

As yet another aspect of this embodiment, the storage system is adapted to be capable of being moved away from the primary work system and replaced with a second storage system.

In accordance with an additional embodiment of the present invention, a desk system comprises a primary work surface, a support system having a plurality of legs, the support system supporting the primary work surface, and a privacy panel coupled to the support system and extending upward from a top of the primary work surface. The privacy panel includes a panel member extending upward from the primary work surface by a predetermined distance, and a panel extension member. The panel extension member is adapted to be disposed within the panel member when not in use and is adapted to extend upward from the panel member when in use.

As an aspect of this embodiment, the panel extension member includes a shade anchor and a shade coupled to and extending from the shade anchor, the shade anchor being disposed with a top portion of the panel member when the panel extension member is both in use and when not in use.

As another aspect of this embodiment, the shade extends downward from the shade anchor when the panel member is not in use, and the shade extends upward from the shade anchor when the panel member is in use.

As a further aspect of this embodiment, the panel member includes a reversible surface, the reversible surface having a first side and a second side, each of the first and second sides having a pin-up board or magnetic board.

In accordance with a further embodiment of the present invention, a desk system comprises a desk having a primary work surface with front and rear edges, a support system supporting the primary work system, and a plurality of legs supporting the support system. The support system has a longitudinal central spine and left and right ribs, the central spine extending from substantially a mid-section of the left rib to substantially a mid-section of the right rib, each of the central spine, left rib and right rib adapted to enable for distribution of power and/or data to at least one electrical device used by a user of the respective desk, and the support system is adapted to distribute the power/or data at an end of the left and/or right ribs to an adjacently disposed desk.

As an aspect of this embodiment, the support system has a central rib extending from substantially a mid-section of the central spine to the rear edge of the primary work surface, the support system being adapted to distribute the power and/or data at an end of the central rib at the rear edge of the primary work surface to an adjacently disposed desk.

As another aspect of this embodiment, the desk constitutes a first desk, and the desk system further comprises a second desk having a primary work surface with front and rear edges, a support system supporting the primary work system, and a plurality of legs supporting the support system, the second desk being adjacently disposed to the first desk and receiving the power and/or data from the first desk.

As a feature of this aspect, the first and second desks are disposed at right angles to one another.

As another feature of this aspect, the second desk receives the power and/or data from the first desk at a rear end of the left or right side of the first desk.

As a further feature of this aspect, the support system of the first desk has a central rib extending from substantially a mid-section of the central spine to the rear edge of the primary work surface of the first desk, and the second desk receives the power and/or data from the first desk at a center rear of the first desk via the central rib of the first desk.

As further aspect of this embodiment, the first and second desks are disposed back to back with one another, and the support system of each of the first and second desks has a central rib extending from substantially a mid-section of the central spine to the rear edge of the primary work surface of the respective desk, and the support system of the first and second desks being adapted to transfer power and/or data to each other via the respective central rib of the first and second desks.

As a feature of this aspect, the desk system further comprises third and fourth desks disposed back to back with one another, the first and seconds desks disposed adjacent to the third and fourth desks in a staggered configuration.

As an additional aspect of this embodiment, the desk constitutes a first desk, and the desk system further comprises second, third and fourth desks, each of the second, third and fourth desks having a primary work surface with front and rear edges, a support system supporting the primary work system, and a plurality of legs supporting the support system, the first, second, third and fourth desks being configured in a windmill pattern.

As a feature of this aspect, the support system of each of the second, third and fourth desks has a longitudinal central spine and left and right ribs, the central spine extending from substantially a mid-section of the left rib to substantially a mid-section of the right rib, and each of the first, second, third and fourth desks adapted to transfer power and/or data to an adjacently disposed desk via one of the ribs of the respective desk.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, in which.

DETAILED DESCRIPTION OF THE INVENTION

As will be appreciated from the foregoing discussion, the office furniture system of the present invention creates a more efficient and organized use of space than existing systems on the market. Each individual "complete station" can be joined to another "complete station" in various configurations allowing for numerous layout/packing possibilities. Each complete station comes fully loaded and can stand alone or be joined to other stations. This strategy complements the trend in business of rapidly changing business practices and sizes.

Figure 1:
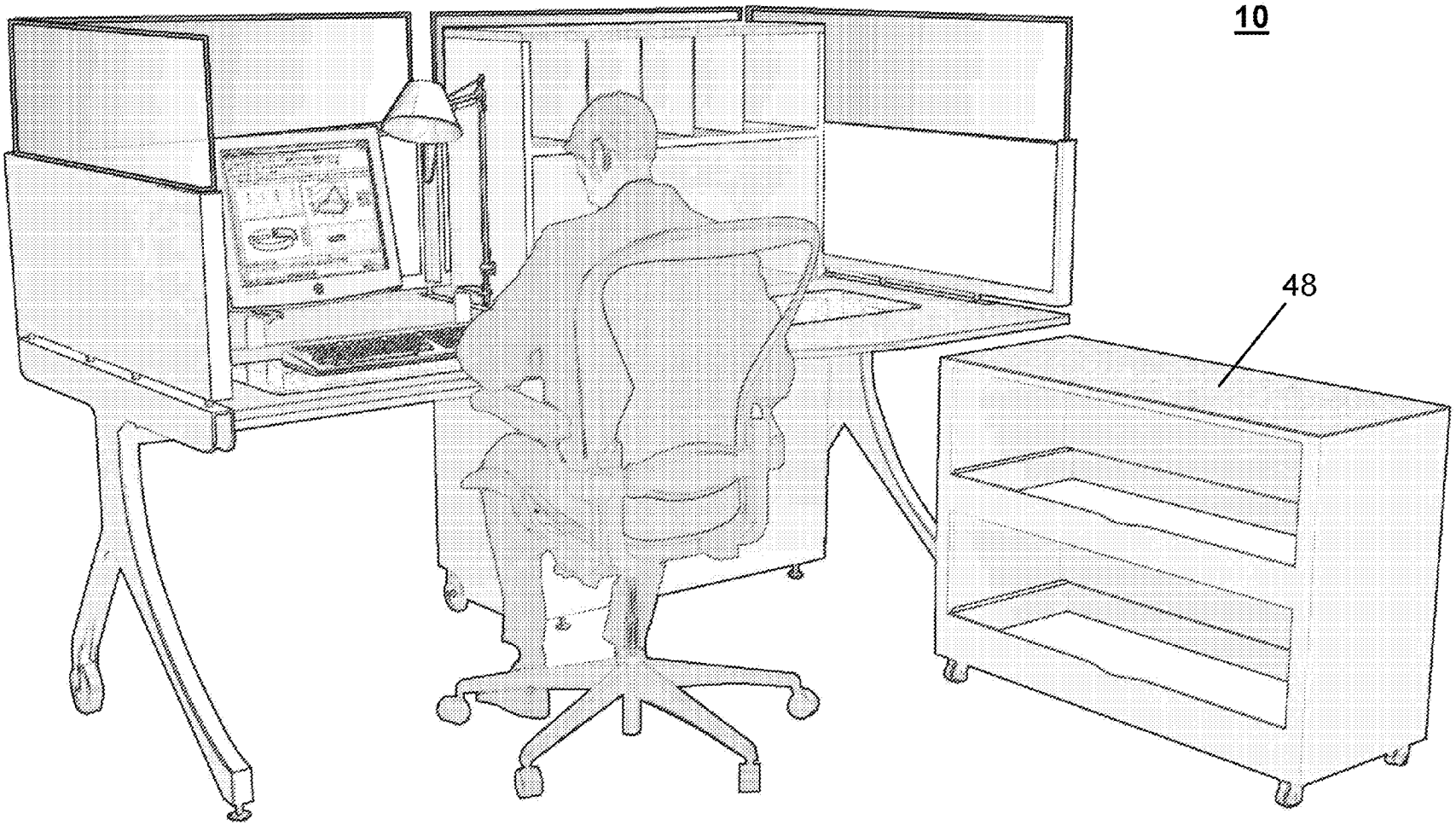
FIG. 1 is a schematic illustration of a desk station in accordance with the present invention.

Referring to the drawings, FIG. 1 shows a complete station 10 (or "desk station" or, simply, "station") in particular exemplary configurations having various features in accordance with the present invention. As particularly shown in FIG. 2, station 10 of the present invention includes, among other things, a desk portion 12 ("desk 12") in which a Display Pool™ storage/display feature 20 (hereinafter, for convenience, "display pool") is disposed, a novel cable management system (not particularly shown in FIG. 2), one or more accessory brackets 30 for supporting various accessory items, such as an LCD monitor 32 and a lamp 33, vertically operable storage 40, and privacy panels 50. These components and features of station 10 and other components and features of the present invention are further discussed below.

Desk and Display Pool™

Figure 3A:
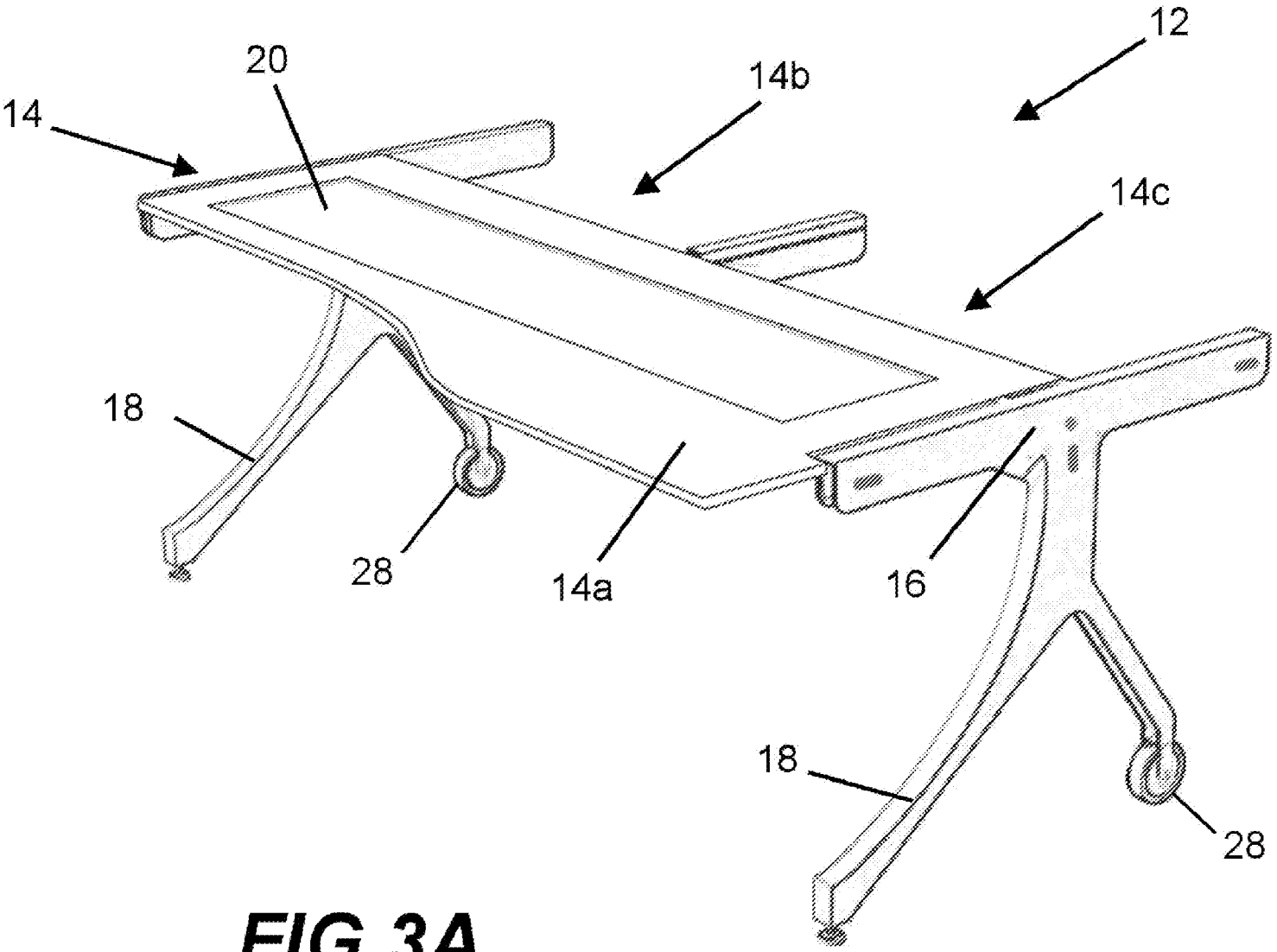
FIGS. 3A and 3B show particular configurations of a desk of the present invention.
Figure 3B:
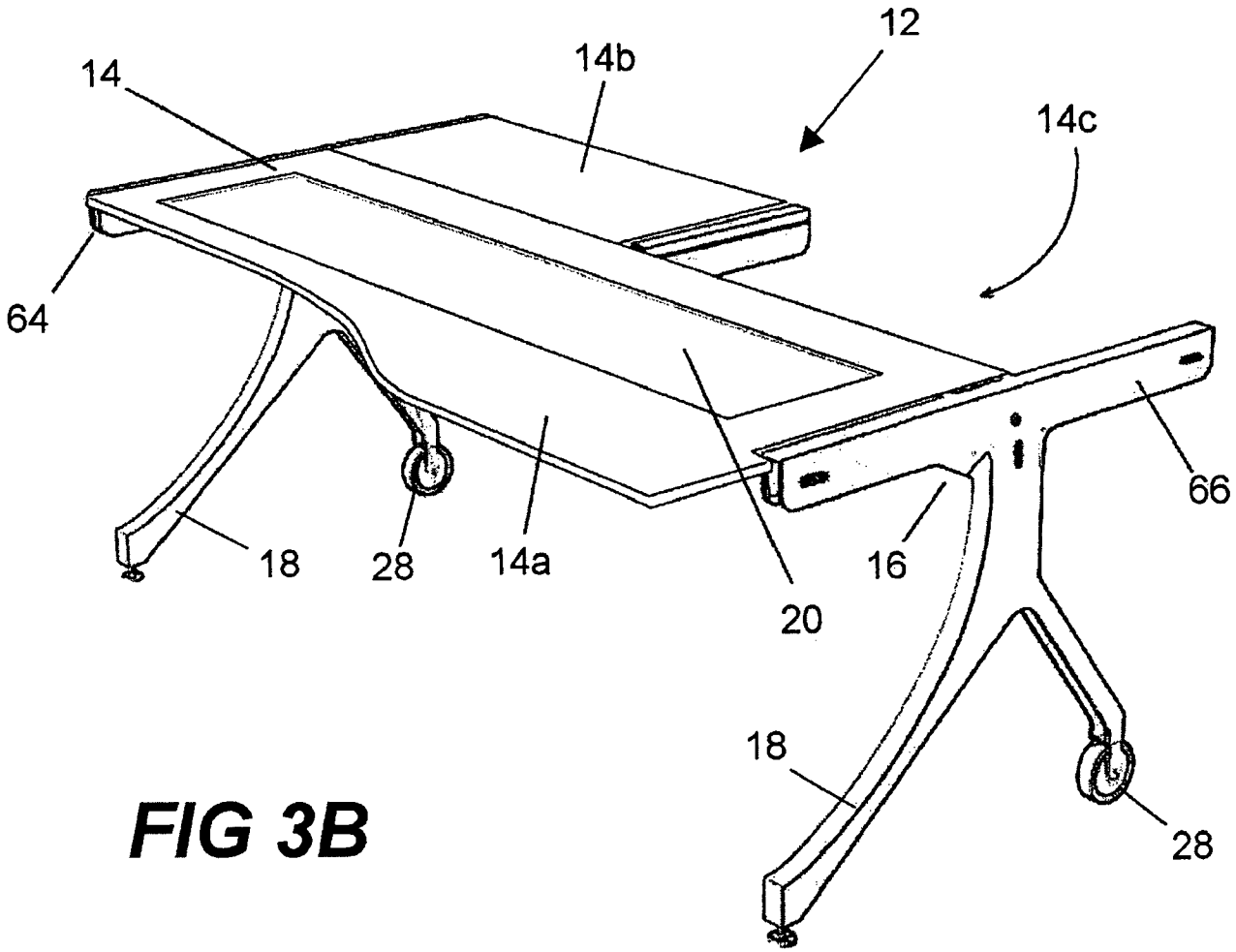

FIGS. 3A and 3B show particular configurations of desk 12 of the present invention. As shown in both FIGS. 3A and 3B, desk 12 includes a primary work surface 14, a frame 16 supporting primary work surface 14, and legs 18 supporting frame 16. Legs 18 may come in various shapes, sizes and design, as is well known in the art. Frame 16 and legs 18 may be included within a single, integral component or be separate components securely coupled to one another.

The primary work surface 14 (or simply "surface 14") is comprised of various sections, including a front section 14*a* and two rear sections 14*b* and 14*c*. Both rear sections 14*b* and 14*c* are shown removed in FIG. 3A, and rear section 14*c* is shown removed in FIG. 3B, as discussed further below.

Figure 2:
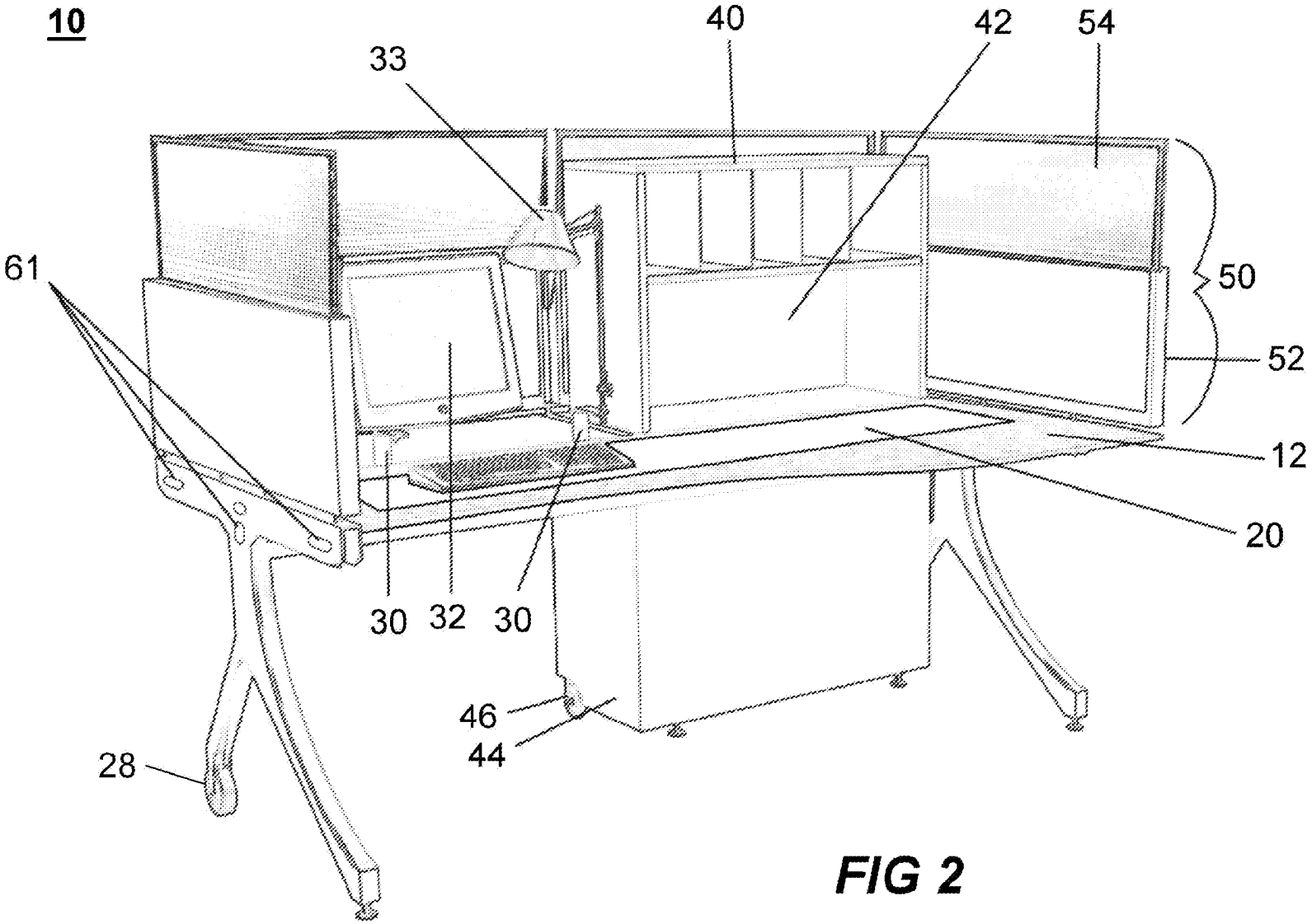
FIG. 2 is another schematic illustration of the desk station of the present invention.
Figure 4:
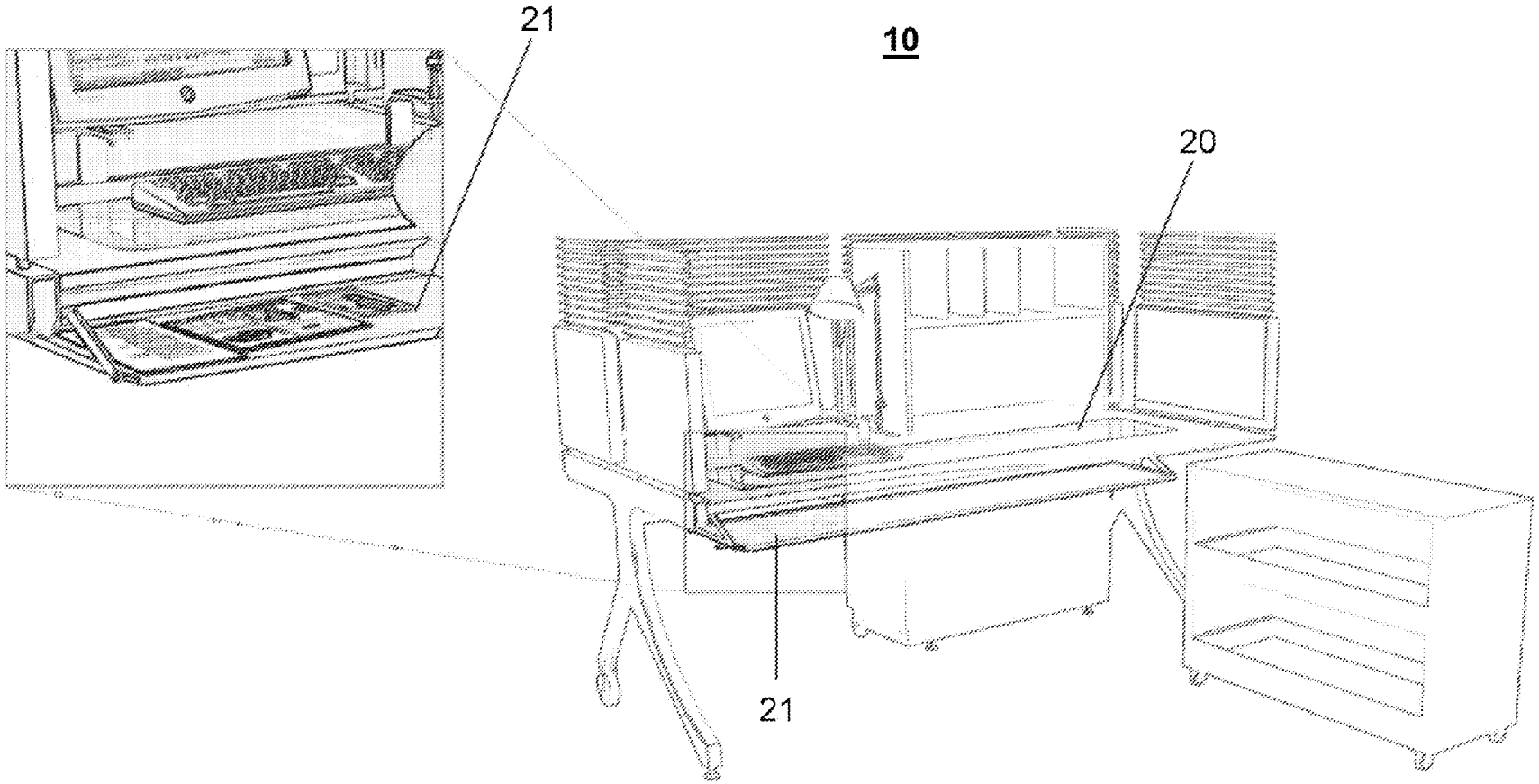
FIG. 4 is a schematic illustration of the desk station of the present invention particularly showing the display pool of the present invention.

In accordance with the present invention, and referring to FIGS. 2, 3A and 3B, front section 14*a* includes, integrated within it, display pool 20 that is designed for additional storage and/or display surface area. In one variation, display pool 20 includes a flush, preferably clear, window embedded in the surface 14*a* of the desk 12 with an accessible tray 21, as shown in FIG. 4, disposed beneath the window. The tray can hold documents, photos, and reference material that are visible through the window but does not clutter the work-surface. In one variation, the tray is substantially flat and designed so that the top surface of the tray, that is, the surface on which documents may be placed, is flush or nearly flush with the underside (i.e., bottom surface) of the clear window.

In another variation, display pool 20 is sized and shaped to accommodate a flat-panel monitor. In yet a further variation, the display pool includes multiple sections for providing multiple trays, multiple flat-panel displays or a combination thereof.

The trays mentioned above may be sufficiently thin or even be flat so that papers, photos and the like may be displayed immediately beneath (i.e., flush with) the window or may have sufficient depth for use in containing other items, such as pencils, pens, calculators or other non-flat items. In the variations mentioned above, the window may be lifted in any manner known in the art, so as to have access to the tray. For example, the window may be hinged to surface 14*a* in which it is embedded. As another example, the window may include an aperture of sufficient size to enable a user to simply place a finger within the aperture and to lift the window to gain access to the tray. Other known methods of accessing the tray may be utilized.

In a preferred variation, tray 21 is hinged, or double-hinged, to the underside of surface 14*a* so that it mechanically lowered to gain access to the tray's contents. The hinged attachment mechanism may be lockable in either or both the raised or lowered positions, to allow for the storage of relatively heavy items. Alternatively, well known friction-type hinges may be employed to allow for the free movement (i.e., raising and lowering) of the tray.

From the foregoing discussion, it is appreciated that the display pool feature of the present invention increases usable work space without enlarging the surface area of the desktop. The display pool further allows for more information to be provided close to the desk user. Moreover, additional usable work space is achieved by increasing the size of the display pool and/or providing multiple display pools within a single desk system of the present invention. Increased usable work space is further discussed below.

Cable Management System

Figure 5:
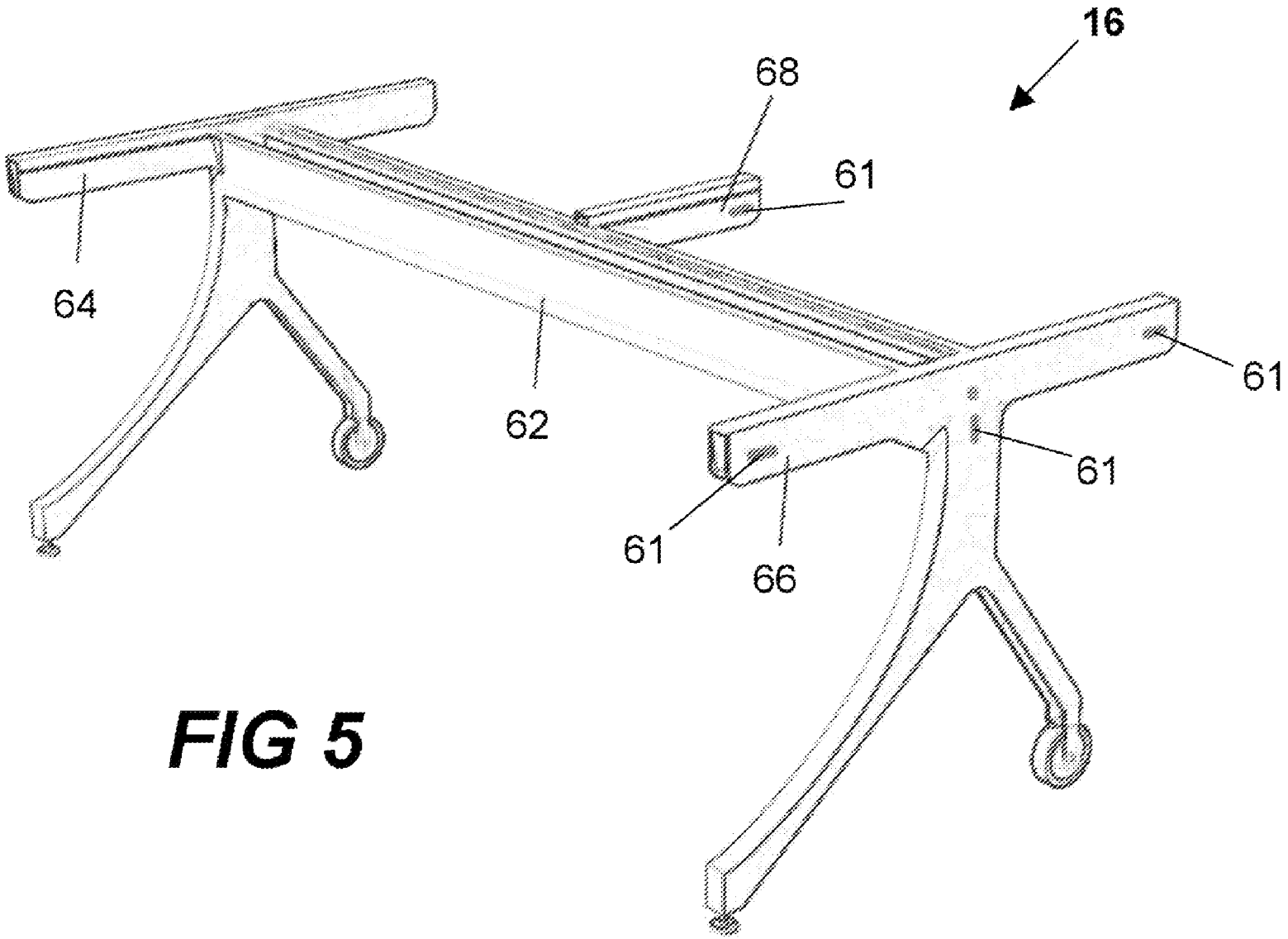
FIG. 5 shows the desk frame of the present invention.

FIG. 5 shows desk frame 16. As shown, frame 16 includes a central spine 62, a left rib 64, a right rib 66 and a central rib 68 (the terms "left," "right," "central," and other terms are used herein for convenience only). The left and right ribs 64 and 66 extend from the front of desk 12 to its rear, the central rib 68 extends from the center to the rear, and central spine 62 extends from the center of left rib 64 to the center of right rib 66. In a variation, central spine 62 may be off-center. In another variation, the central rib extends from the front of the desk to the rear. In yet another variation, there is no central rib.

As used herein, various spatial terms including "center" (e.g., as in center of right rib 66), "mid-section" and the like are intended to be loosely defined and generally refer to a position somewhere between approximately one-third to approximately two-thirds along the reference item, as opposed to meaning exactly halfway along the reference item. As an example, central spine 62 may extend between left and right ribs 64 and 66 at positions that are disposed away from the ends of left and right ribs 64 and 66 (e.g., somewhere between approximately one-third the distance from one end to approximately one-third the distance from the other end of the respective rib).

In accordance with the present invention, desk station 10 includes a cable management system that employs the central spine 62, as well as the left, right and central ribs 64, 66 and 68, for the supply and transfer of power and data, as desired, to and between electrical devices utilized in the desk station. The central spine 62 and each of the ribs 64, 66 and 68 include internal channels through which cabling (e.g., power, data, etc.) may be disposed, as desired. Thus, appropriate cabling may be extended between any of the ribs and the central spine, as further described below.

The desk frame 16 further includes a set of apertures 61 disposed at the two ends of the central spine 62, disposed at or near the front and rear ends, as well as the center, of the left and right ribs 64 and 66, and disposed at or near the rear end of central rib 68, to enable for the feeding of cables from outside the desk to any one of the internal channels disposed within the ribs or the central spine 62. Further, additional apertures may be disposed within any of the bottom portions (i.e., surfaces facing downward toward the floor) of the central spine 62, and left, right and central ribs 64, 66 and 68 to provide additional locations through which cabling may be provided to the desk system of the present invention.

Figure 6:
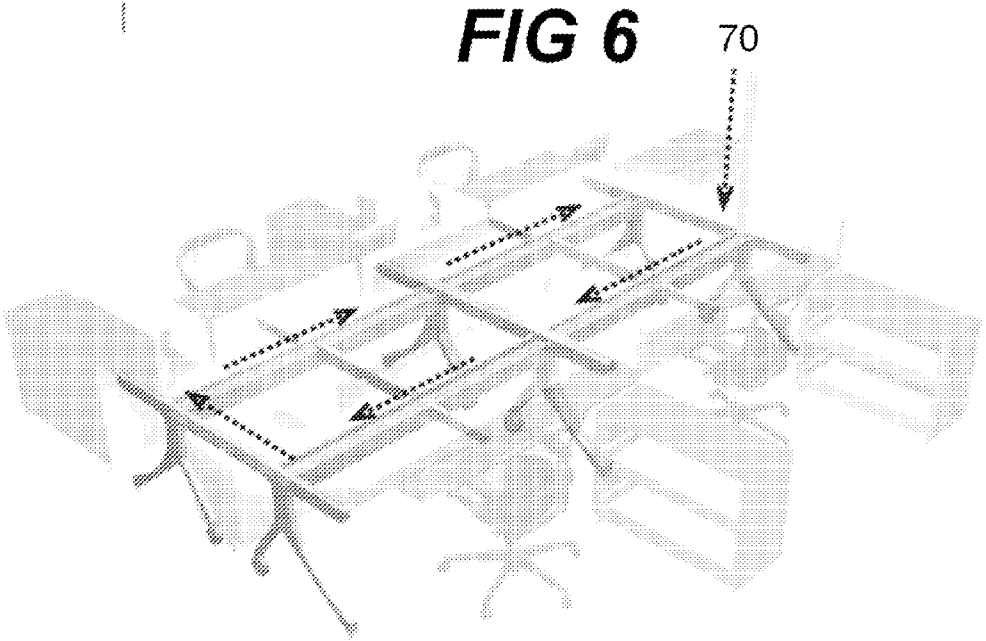
FIG. 6 schematically illustrates the distribution of power and/or data between multiple desks of the present invention.

In addition to enabling the supply of power and/or data cable to a single desk system embodying the present invention, the structure of the cable management system including the central spine and the left, right and center ribs, along with the channels therein, and the various apertures described above, enables for the distribution of power and/or data between generally adjacently disposed desks embodying the present invention. For example, FIG. 6 schematically shows four desks of the present invention in a two by two arrangement (for convenience, only frames of the desks are shown in FIG. 6), wherein power and/or data travels along the path identified by arrows 70 (the directions of the arrows in FIG. 6 are provided for schematic illustration only). As shown, power and/or data may be provided to one desk station from above (e.g., through a ceiling panel) or via an adjacent desk station. Power and/or data also may be supplied from below a desk station, from a wall panel or other location. In either case, the "daisy chain" style afforded by the cable management system of the present invention allows for power and/or data to be supplied from a great number of locations to one or more of the herein-described desk stations. Distribution of power and/or data between desk stations is accommodated by utilizing desired apertures within the central spine or any of the ribs 64, 68 and 68. Multi-desk configurations in accordance with the present invention are further discussed below.

Figure 7:
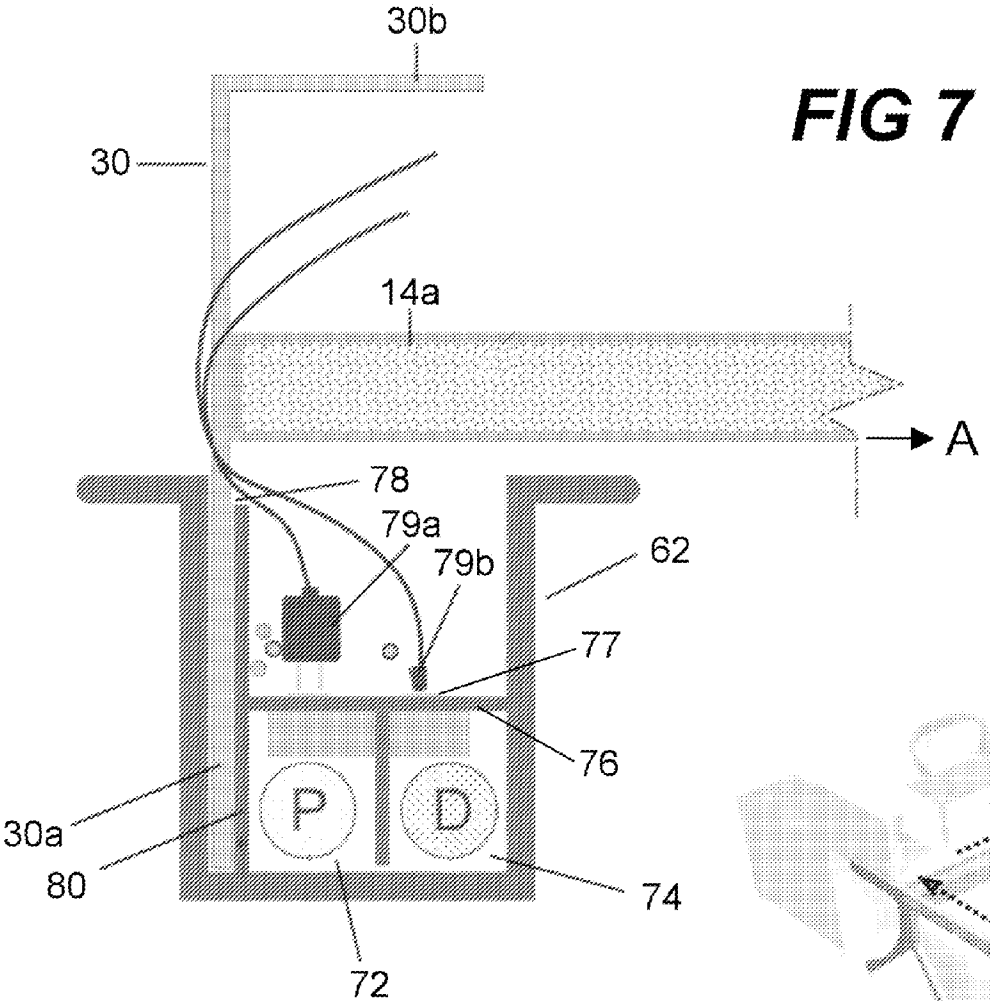
FIG. 7 shows a cross-section of the desk's central spine in accordance with the present invention.

FIG. 7 shows a cross-section of the desk's central spine 62. As shown, spine 62 includes lower compartments 72 and 74 for the distribution of power and data via respective power P and data D cables. In a variation, a single lower compartment may be provided that contains both power and data distribution cables. As used herein, data includes computer networking cabling, television cabling, telephone cabling or other cabling for the distribution, supply and/or communication of other information that can be transmitted. Spine 62 includes a divider 76 and preferably includes power and data outlets 77 disposed within divider 76 (or "dividing wall") into which standard or non-standard power and data plugs 79*a* and 79*b* of electrical devices may be inserted. Exemplary electrical devices include lamps, computer monitors, computers, telephones, etc. The distribution and supply of power and data via central spine 62 is further discussed below.

In accordance with another feature of the present invention, the desk's central spine 62 and ribs 64, 66 and 68 are designed to allow the primary work surface's front section 14*a* to slide forward (in direction "A" shown in FIG. 7) to expose spine 62 to allow easy access to the desk system's cable management system (also referring to FIG. 3A). Preferably, the primary work surface's front section 14*a* can be slid forward (i.e., toward the desk user) by the user or other person for a limited distance of, for example, five inches so that the cable management system may be accessed. In a variation, any suitable locking mechanism may be employed to prevent the unauthorized sliding forward of the primary work surface's front section 14*a* so that the cabling disposed within the desk system is protected against unauthorized access. The particular design of suitable locking mechanisms are well known and are thus not described herein.

In a variation, rather than sliding a desk section forward (or in another direction) to access the cable management system of the present invention, in particular, to access the central spine and the cabling and other items disposed therein or to install such cabling, the central spine is accessed via a hinged portion of the desktop surface. That is, a portion of the primary work surface's front section 14*a* (or another section) disposed above the central spine is hinged (by any suitable hinge mechanism) to the remainder of the surface wherein the cable management system is accessed by lifting the hinged section (i.e., flipped up).

Accessory Bracket

Figure 8:
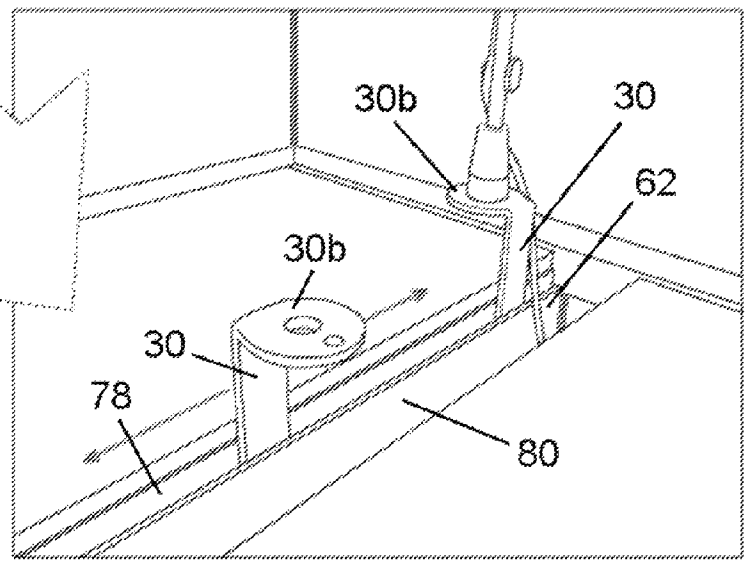
FIG. 8 is a perspective view schematically illustrating accessory brackets of the present invention.
Figure 9:
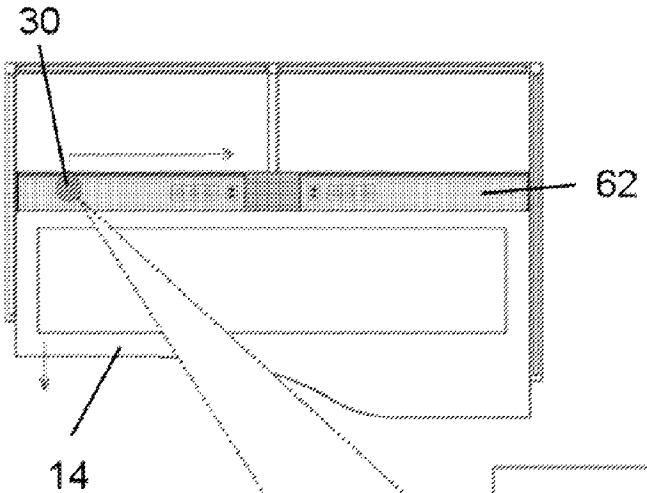
FIG. 9 is a schematic top plan view of the desk particularly showing an accessory bracket of the present invention.

FIG. 7 also shows accessory bracket 30 in accordance with another feature of the present invention. As shown, accessory bracket 30 extends into a bracket receiving aperture 78 (or simply "aperture 78") disposed within the rear (from the perspective of the desk user) of spine 62. FIG. 8 is a perspective view schematically illustrating two accessory brackets 30 extending upward from aperture 78 disposed within spine 62. As shown, accessory bracket 30 is utilized to support one or more devices. FIG. 2 schematically shows accessory brackets 30 supporting a flat panel monitor 32 and a lamp 33. The supported devices (e.g., monitor 32) are disposed at a central location (from front to back) above primary work surface 14, such as shown in FIG. 9. As is appreciated, such a central support maintains the device supported at a reasonable distance from the desk user, without additional support structure that would otherwise take up additional desktop space. Further, bracket 30 preferably extends upwards from primary work surface 14 for a sufficient distance (e.g., 6 inches, 12 inches, etc.) to allow the desk user to utilize the space disposed beneath the item supported by bracket 30.

Referring again to FIGS. 7 and 8, the spine's aperture 78 is separated from the other compartments within the spine by an inner channel wall 80. A first end 30*a* of accessory bracket 30 (hidden in FIG. 8) is disposed within aperture 78 of spine 62 and is thus supported thereby. The other end 30*b* of accessory bracket 30 is designed to be coupled to and support an electrical device, such as a flat-panel computer monitor, a television display, a lamp, a telephone or other electrical device. Also, the device supported by bracket 30 may be non-electrical, such as a drawing board or other device or item desired to be used by the user of the desk station of the present invention. In a particular version, accessory bracket 30 is a universal-type bracket designed to be utilized to support different types of devices. In other variations, different types of accessory brackets 30 are employed, each for use with a particular type of device. For example, one type of accessory bracket is designed to be inserted into and supported by spine 62 as mentioned above that is designed to support a flat panel monitor. Another type of accessory bracket may be particularly designed to support, for example, a certain type of telephone. In any event, the particular design of the support end (e.g., end 30*b*) of accessory bracket 30 may be varied and modified as necessary, so as to be able to accommodate any device. For each of these different types of accessory brackets, the bracket may encompass other functionality, such as being able to rotate, expand and telescope.

Figure 10A:
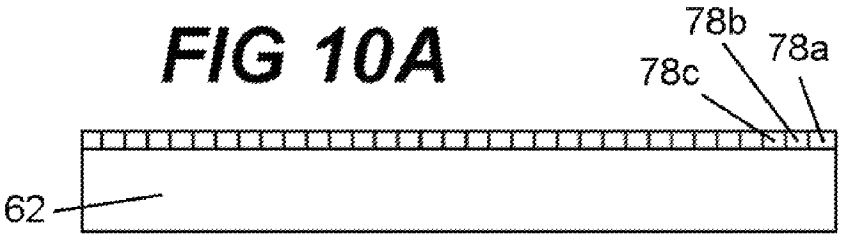
FIGS. 10A and 10B schematically illustrate top plan views of spines in accordance with different embodiments of the present invention.

In accordance with one version of the invention, spine 62 includes multiple apertures 78*a*, 78*b*, 78*c*, etc., as shown in the schematic top plan view of FIG. 10A. Accessory bracket 30 may be placed in any of the apertures 78*a*, 78*b*, 78*c*, etc. to allow for the desired placement of an accessory above surface 14 of the desk. Spine 62 may include any number of apertures as practical or desired. Preferably, the apertures are disposed at equal distances (e.g., every 6 inches) along spine 62. Smaller and larger apertures, as well as more or less apertures than shown in FIG. 10A, can be provided within spine 62 to accommodate accessory brackets of different sizes. For example, smaller brackets can be utilized to support light-weight devices and larger brackets (e.g., wider brackets) can be utilized to support heavier devices.

Figure 10B:
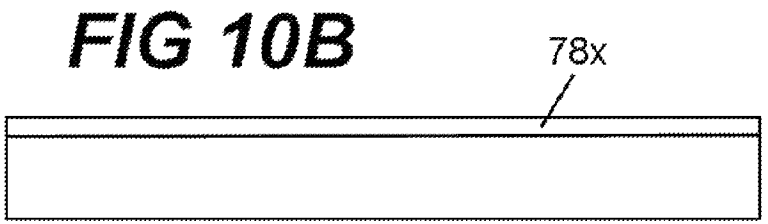

The spine may include a single longitudinal channel 78*x*, as shown in FIG. 10B, that extends along the entire width of the desk. With a single channel (or two, three, etc., relatively long channels), accessory brackets can be utilized such as described above with the additional capability that an accessory bracket can be moved (e.g., by the desk user) horizontally (e.g., side to side) while the accessory bracket remains disposed within the spine's channel (schematically represented by the arrows shown in FIGS. 8 and 9). An accessory bracket can further include wheels, ball bearings or other suitable structure disposed at the bracket's bottom end to facilitate side-to-side movement of the bracket during use, if necessary, such as side-to-side movement of a bracket supporting a relatively heavy object (e.g., a flat panel display). The accessory bracket optionally can include a suitable bolt or other fixing mechanism to fix the bracket to the spine after the bracket is moved to its desired location.

After placement of one or more accessory brackets within the spine, the desk user or other individual slides the primary work surface's front section 14*a* (in a direction opposite to arrow A shown in FIG. 7) to conceal spine 62 thus concealing the desk system's cable management system.

Tackable Binder™

As mentioned above, various devices, electrical and non-electrical, may be supported by the accessory brackets of the present invention. One such device that can be supported is a so-called tackable binder, which is schematically illustrated in FIGS. 11A-11D. The tackable binder 90 of the present invention includes a binder 92 with multiple tackable pages 94 (also called binder pages). Binder 92 as shown includes two rings 96, although more or less rings (spiral or non-spiral type) may be employed. In one variation, rings 96 can be opened and closed to allow for the insertion and removal of binder pages, as desired. Other manners of coupling the binder pages may be employed and thus the invention is not limited to the design specifically shown in FIGS. 11A-11D.

In accordance with the invention, each binder page 94 is tackable in that something, generally a document, photograph, etc., can be tacked or otherwise fastened to it. A binder page 94 may be single sided (i.e., tackable on only one side) or double sided (i.e., tackable on both sides 94*a*, 94*b*), which doubles the surface area that may be utilized. Each side of each binder page may be made of cork (including synthetic cork), a magnetically attractive material (either the magnetic side or material attracted to a magnet), whiteboard, or other known material utilized for tacking purposes (e.g., an adhesive surface). The tackable binder includes multiple binder pages and can be turned to reveal one or more of the pages within the binder. When not in use, the binder can be closed to conceal the pages and the documents and other items attached thereto.

Figure 11D:
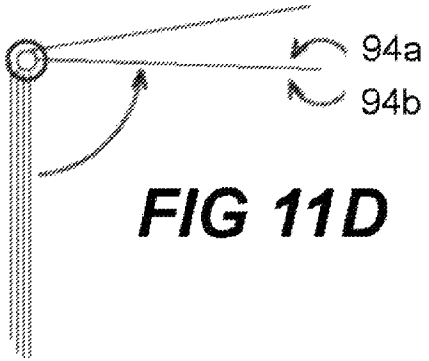
FIGS. 11A to 11D are schematic illustrations of the tackable binder of the present invention.
Figure 11C:
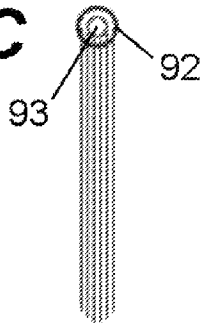
Figure 11B:
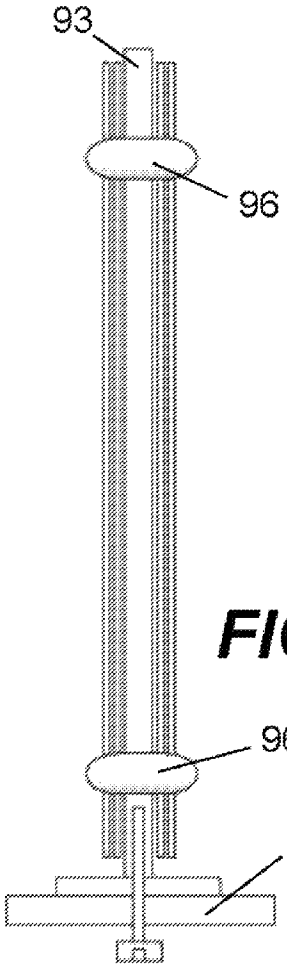
Figure 11A:
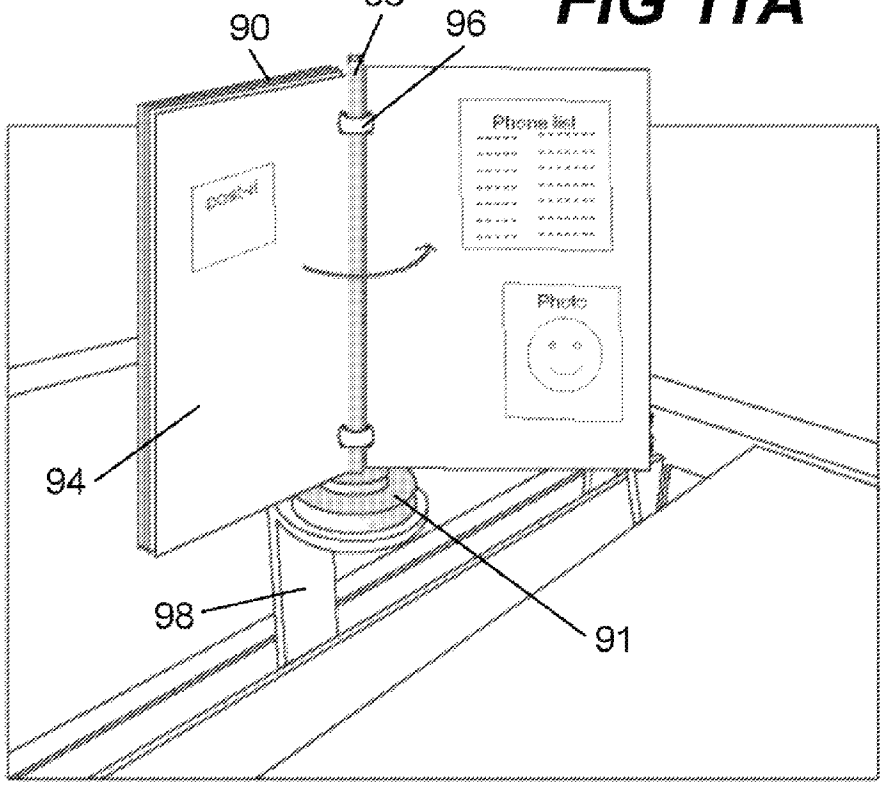

As a preferred feature of the present invention, the tackable binder includes a base 91 and a longitudinal support 93 coupled to and extending from the base. Longitudinal support 93 may be a rod (as shown in FIGS. 11A-11D), a flat support, or other suitably shaped support. Rings 96 extend around longitudinal support 93 as shown in FIGS. 11A and 11B. Preferably, each ring 96 is fixed (e.g., at one location along the ring) to longitudinal support 93. Further, each binder page 94 is made of a sufficiently firm material to be self-supporting to allow for the easy display of the binder pages so that the tackable binder may be utilized with longitudinal support 93 extending vertically, as best shown in FIG. 11A. The tackable binder may be closed, such as shown in FIG. 11C, or opened, such as shown in FIGS. 11A and 11D.

Each binder page 94 may be freely movable around longitudinal support 93 to allow quick and easy "flipping" of the pages during use. In a variation, one or more mechanisms may be employed to prevent the free movement of a binder page, that is, to cause one or more binder pages to be generally locked in place as desired. That is, in order to prevent undesired movement of one or more binder pages, for example, caused by air current or by gravity (e.g., should longitudinal support 93 not be completely vertically aligned) or by other means, the tackable binder optionally may include structure to prevent such undesired movement. As one example, the top surface of base 91 may include upwardly extending protrusions or teeth disposed around longitudinal support 93. In this example, bottom edges of each binder page 94 (at the end near longitudinal support 93) are naturally placed within spaces formed between the protrusions extending from base 91. Then, to move a binder page, the user lifts the page slightly and moves it to the desired location, and then releases it thus causing the bottom of the page to be disposed and maintained between another such space. As another example, one or more rings 96 can be designed to provide a small amount of friction to the supported pages. Other techniques may be employed.

In accordance with the present invention, tackable binder 90 may be an independent stand-alone device with base 91 as the sole means of support or tackable binder 90 may be coupled to and supported by one of the above-described accessory brackets (accessory bracket 98 shown in FIG. 11A) and thus used in combination with the desk system of the present invention. Tackable binder 90 may include a clip mechanism (in place of base 91) for attachment to an edge of a surface such as an edge of the desk or to one of the above-described accessory brackets.

Preferably, the tackable binder is held by accessory bracket 98 sufficiently above the desktop surface by an amount (e.g., 6 inches, 12 inches, etc.) that allows the desk user to utilize the space immediately beneath the tackable binder. Accordingly, the tackable binder advantageously provides multiple pages of display without taking up any space on the desk surface. The tackable binder may be fixed to the accessory bracket in any suitable manner so that it does not move. In a variation, the top portion of the accessory bracket is rotatable to allow the user to rotate the tackable binder between a forward facing position (e.g., during use) and a position facing away from the user (e.g., when not in use). In the latter position, the tackable binder preferably is positioned towards the rear portion of the desk to minimize clutter in the work areas closer to the user.

Vertically Operable Storage

Figures 12A, 12B:
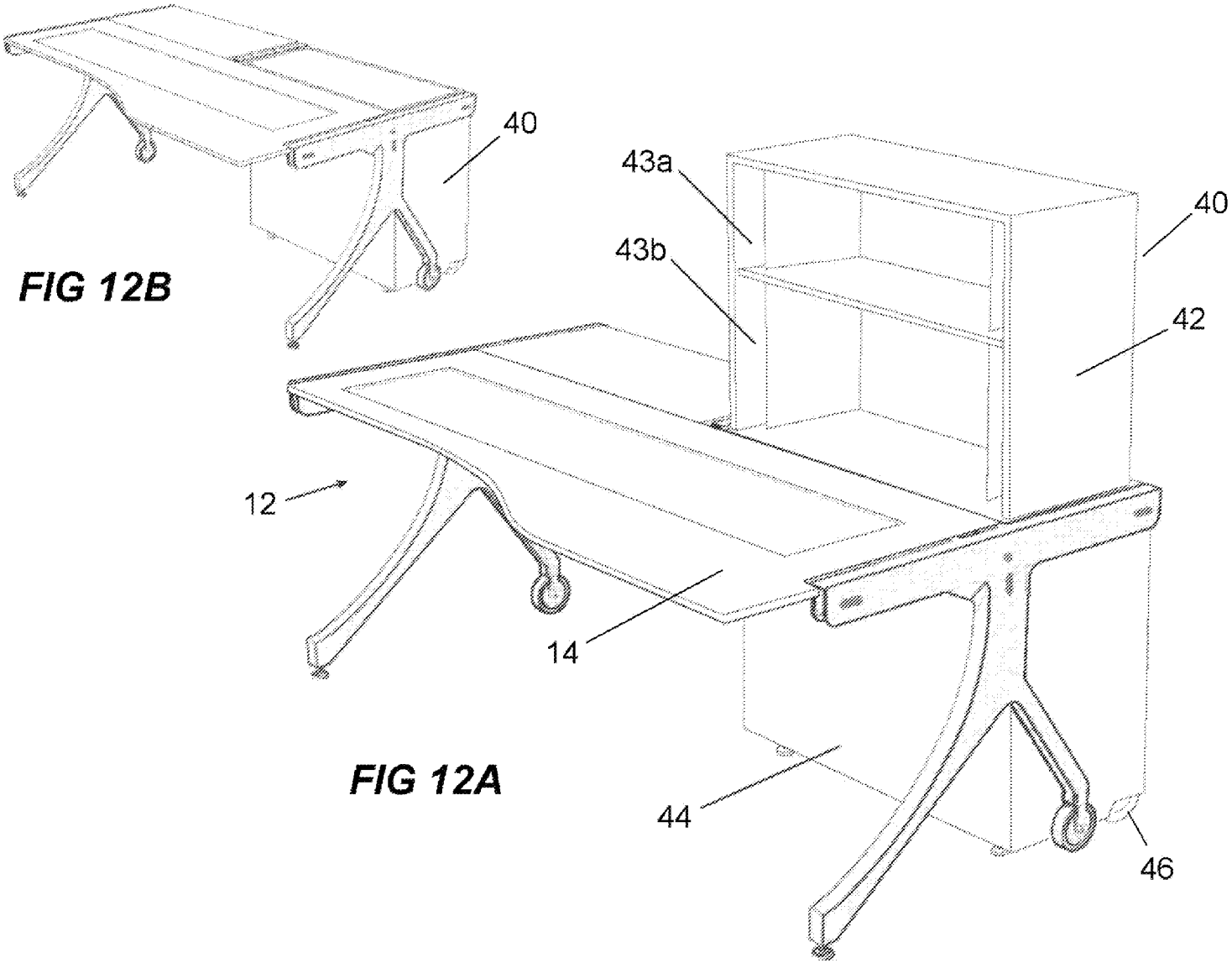
FIGS. 12A and 12B are schematic illustrations particularly showing the vertically operable storage of the present invention.

FIGS. 12A and 12B (as well as FIG. 2) schematically show the vertically operable storage 40 (or, simply, "storage 40") (also known as a "PopCart™") disposed within the desk system in accordance with the present invention. As discussed further below, vertically operable storage 40 utilizes volume under the worktop, space that almost always goes unused.

As shown in FIG. 12A, as well as FIG. 2, storage 40 includes a storage area 42 (also called "inner box") for files, documents and other items desired to be stored, and a cabinet 44 (also called "outer box") into which storage area 42 is lowered when not in use. Storage area 42 is raised to expose the contents and is lowered to protect and hide the contents. In accordance with the present invention, when storage area 42 is fully lowered into cabinet 44 (also identified as the closed position), storage 40 is fully disposed beneath desk 12 and its top surface (i.e., the top surface of storage area 42) is flush with the desk's primary work surface 14, as shown in FIG. 12B. Storage 40 may be disposed in the rear left side or in the rear right side of desk 12.

FIGS. 12A and 12B show the configuration when storage 40 is disposed in the rear right side of desk 12. In such case, rear section 14*c* of the primary work surface 14 is not utilized (see FIG. 3B). As a variation, storage 40 may be disposed in the rear left side of desk 12, in which case rear section 14*b* is not utilized. As yet another variation, two vertically operable storages may be utilized, one disposed in the rear left side of the desk, the other disposed in the rear right side of the desk, in which case neither rear section 14*b* nor rear section 14*c* is utilized (see FIG. 3A).

When storage 40 is closed (i.e., storage area 42 is in the fully lowered position), storage 40 is fully concealed (i.e., fully beneath the desk) and the top surface of storage area 42 is flush with the primary work surface so that it may be utilized as primary work space by the desk user.

Figures 13A, 13B, 13C:
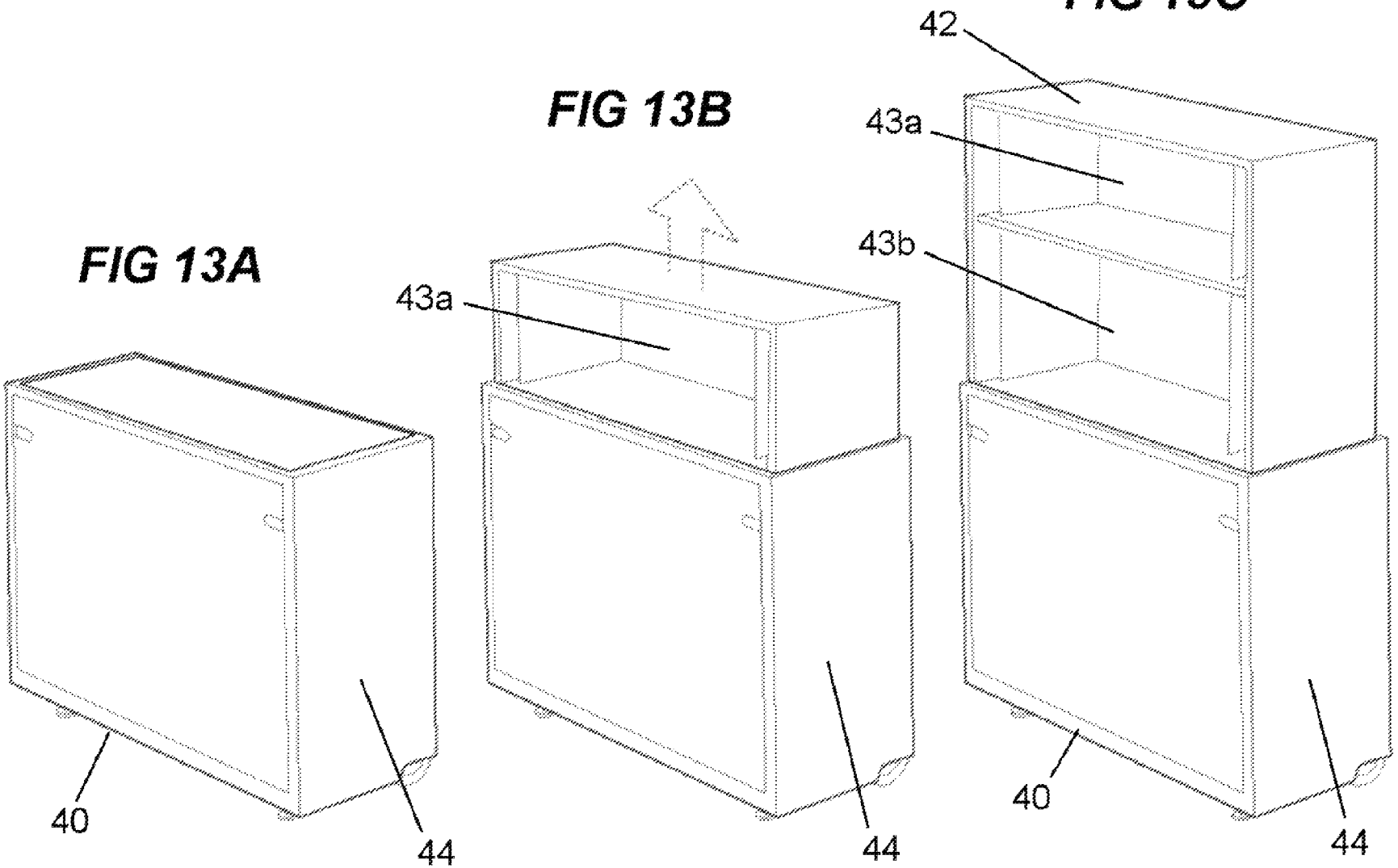
FIGS. 13A to 13C are additional schematic illustrations of the vertically operable storage of the present invention.

During operation, the desk user or other individual can raise and/or lower storage area 42 to reveal or conceal the documents and items stored therein, as desired. FIGS. 13A, 13B and 13C schematically illustrate different positions of storage area 42. FIG. 13A shows storage 40 in its fully closed position. FIG. 13B shows storage 40 in a partially open position (or partially closed position), wherein only upper area 43*a* is accessible. FIG. 13C shows storage 40 in its fully open position, wherein both upper and lower areas 43*a* and 43*b* are accessible.

FIGS. 12A and 13C show storage area 42 having a particular configuration, that is, with a single upper storage area 43*a* and a single lower storage area 43*b*. Other storage configurations may be employed. For example, FIG. 2 shows the upper storage area divided into five compartments. Thus, each storage area may be divided into any number of compartments, as desired and practical. Moreover, the entire storage area 42 may be divided into a different number of compartments than that shown in the drawings. For example, storage area 42 may be divided into three or more levels of storage. In such case, storage area 42 can be vertically positioned at any appropriate height to reveal one or more of such storage levels. Storage area 42 can, if desired, include only a single level of storage with or without multiple compartments. Thus, the shape, size and number of compartments within storage area 42 are not limited to that shown in the drawings or described herein.

Storage area 42 is lowered and/or raised either manually or, preferably, electrically in any manner that is known in the art. If electrical, a suitable up/down switch preferably is employed, with such switch either wired to or wirelessly connected to the lifting/lowering mechanism within storage 40. Further, the manners in which storage area 42 can be raised or lowered, whether by use of a track or other system, are well known in the art and thus are not discussed herein.

Referring again to FIGS. 12A and 12B, FIG. 12A shows storage 40 in its fully open position and FIG. 12B shows storage 40 in its closed position. In the open position, as shown in FIG. 12A, storage area 42 is open at its front end (i.e., towards the desk user) and thus the distance from the front of the desk to the rear of storage area 42 is substantially the same as the distance from the front of the desk to the rear of the desk when storage 40 is closed, as shown in FIG. 12B. Hence, the amount of volumetric space accessible to the desk user remains, for the most part, substantially the same when storage 40 is in either its open or closed position. More particularly, there is no obstruction or lessening of accessible space when storage 40 is in use. Similarly, the volumetric space and the accessible distance (from the front of the desk) remain constant when storage area 40 is partially open to reveal only upper area 43*a* within storage area 42, as shown in FIG. 13B. Hence, accessible and usable volumetric space remain substantially constant independent of whether or not the contents within storage 40 are being accessed (i.e., whether storage 40 is open, partially open or closed).

In one particular version of the present invention, storage 40 is not fixed to desk 12 but, rather, is an independent unit that, during use, is physically placed beneath desk 12 in the appropriate position (e.g., in the rear right side, such as shown in FIG. 12B). In this version, it is preferred to provide storage 40 with wheels 46 or other suitable device to allow storage 40 to be movable. Thus, storage 40 can be moved, separate from desk 12, at will to other locations within a business and, if desired, be placed beneath another desk system of the present invention. In a particularly useful application, an individual can be "moved" from one desk to another without the need for that individual to "clean out" his/her storage 40. Rather, the individual's storage 40 can simply be moved and disposed beneath the new desk. Although not shown, a suitable locking mechanism can be utilized to secure storage 40 to desk 12 to prevent unauthorized movement of storage 40. Storage 40 can further be fitted with a lock (e.g., a key lock) to maintain storage area 42 in the fully lowered (i.e., closed) position when locked to protect the contents stored therein. Such locking mechanisms are well known in the art and thus are not described herein.

In another version of the present invention, storage 40 is integrated within desk 12. In such case, cabinet 44 of storage 44 may be suspended from the desk's frame 16. In one version, cabinet 44 is suspended between the central rib and either the left or right rib. The various ribs may include slots into which cabinet 44 slides. Other manners of integrating storage 44 with desk 12 may be employed. For additional support, storage 44 can include wheels 46 or other suitable structure.

Privacy Panels (Babble-Blockers™)

FIG. 2 also shows a set of privacy panels 50 in accordance with the present invention. Privacy panels 50 provide a visual/privacy barrier, as well as a sound barrier, to the desk user while allowing light to pass into the desk area.

Privacy panels 50 are particularly described with reference to FIGS. 14A-14E, 15 and 16A-16B. Referring first to FIGS. 14A-14E, privacy panel 50 is comprised principally of two components: a panel member 52 (or "panel 52") and a panel extension member 54 (or "panel extension 54"). Panel member 52 is adapted to be coupled (e.g., via a mounting assembly 53) to the top edge of desk 12 or to frame 16. Generally, during use, panel extension 54 extends upwards from panel member 52 and, when not in use, panel extension 54 is stored within panel member 52.

Figures 14A, 14B, 14C, 14D, 14E:
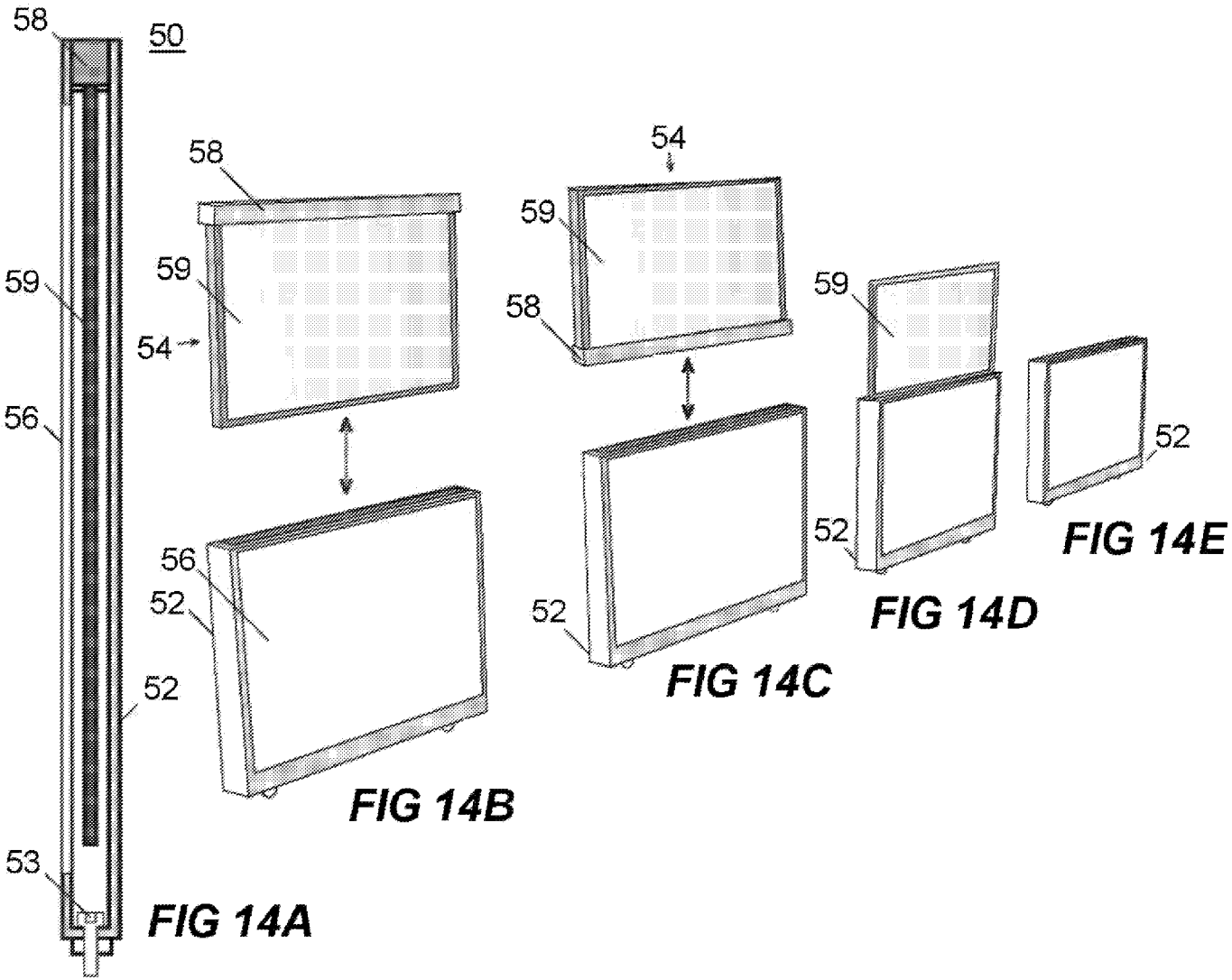
FIGS. 14A to 14E are schematic illustrations of the privacy panel of the present invention.

As shown in FIGS. 14A and 14B, panel member 52 preferably includes an exterior surface 56 in the form of a magnetic whiteboard or other surface usable by the desk user. In a particularly preferred variation, exterior surface 56 is reversible to allow either surface to be exposed and used. In such case, one surface is of one type (e.g., magnetic whiteboard) and the other surface is of a different type (e.g., pin-up board, fabric wrapped board, etc.).

As mentioned above, panel extension 54 can be utilized or not utilized as desired. FIGS. 14A and 14E show panel extension 54 not utilized and disposed within the interior of panel member 52. Panel extension 54 includes a shade anchor 58 and a translucent, substantially rigid shade 59 coupled to and extending from shade anchor 58. When not in use, such as shown in FIG. 14A, shade 59 is stored within panel member 52. To utilize the shade, shade anchor 58 is lifted to reveal shade 59 (see FIG. 14B), shade 59 and shade anchor 58 are turned over (FIG. 14C), and shade anchor 58 is placed within the top of panel member 52 (FIG. 14D). It is seen that whether or not the panel extension is utilized (i.e., whether shade 59 is used), shade anchor 58 is disposed within panel member 52 and thus provides an aesthetically pleasing appearance.

Figure 15:
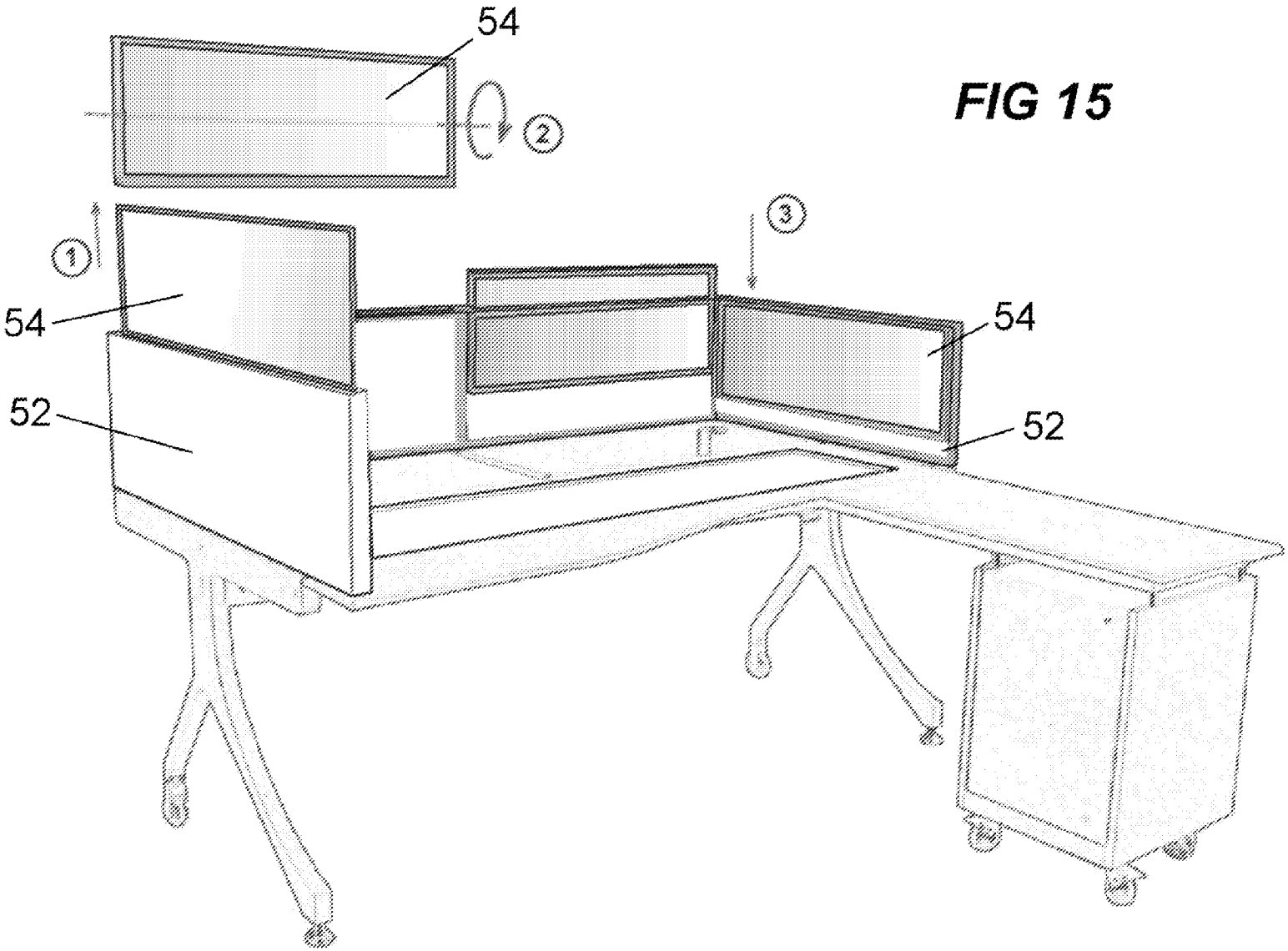
FIG. 15 is a schematic illustration showing the operation of the primacy panel of the present invention.

FIG. 15 is a schematic illustration showing the transitions/steps of when panel extension 54 is to be removed and stored. First, panel extension 54 is lifted off of panel member 52, as represented by step no. 1. Next, panel extension 54 is rotated, as represented by step no. 2. The now-rotated (or flipped-over) panel extension is placed within panel member 52 and fully lowered until panel extension 54 is contained within panel member 52, as represented by step no. 3.

As mentioned above, shade 59 is translucent and substantially rigid. Other types of shade designs may be employed. For example, the shade may be transparent or opaque. The shade may be flat or curved or have another shape (e.g., wavy). The shade may have a fan-like appearance. Further, the shade may be frameless or be disposed within a frame. Still further, the shade may be partially expandable (e.g., an adjustable fan type design) to allow a user to maintain the shade at its greatest height or at a different, lowered height. Other variations may be employed.

When panel extension 54 is not utilized, it preferably is fully disposed and thus concealed within panel member 52. In such position, the top surface of shade anchor 58 is flush with the top surface of panel member 52. To remove panel extension 54 from within panel member 52, shade anchor 58 may be fitted with different components to facilitate such removal. In one version, one or more finger-grabbing holes are disposed within the top surface (i.e., visible surface) of shade anchor 58. In another version, the top surface of shade anchor 58 is fitted with suitable, preferably ornamental, grabs, rings or other suitable mechanical structure that are visible when panel extension 54 is not be utilized (i.e., disposed within panel member 52) and not visible (i.e., contained within panel member 52) when panel extension 52 is being utilized (see FIG. 14D). In yet another version, shade anchor 58 is fitted with a pop-up hook or other suitable pop-up type of device that is normally concealed within the shade anchor.

In a quite different variation, the shade may employ a pull-up mechanism in which the shade does not flip over, as in the variations described above, but rather selectably retracts and extends in the same orientation in and out of the panel, as the user desires. In this variation, the shade and panel are coupled in a manner that does not separate.

Figure 16A:
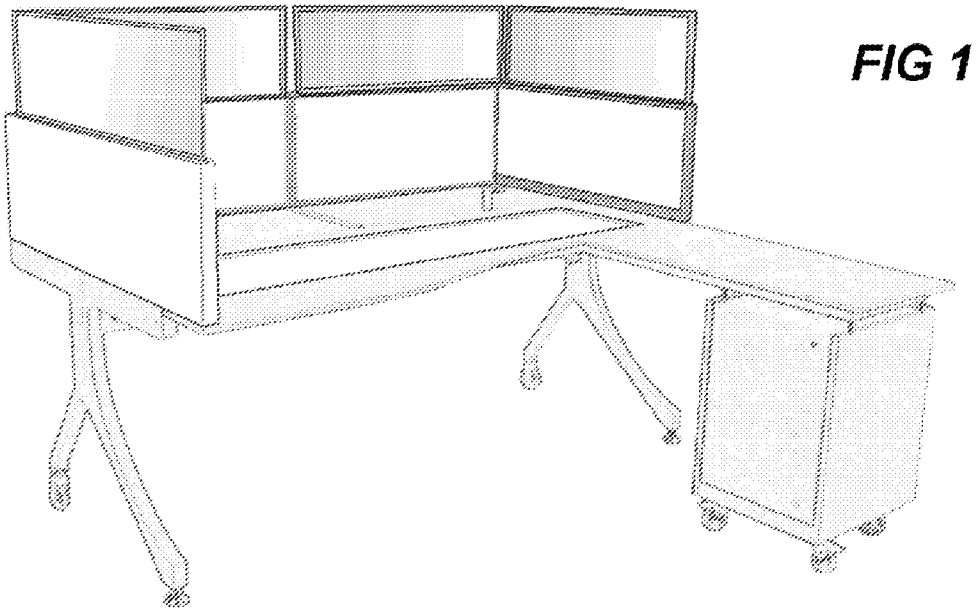
FIGS. 16A and 16B are schematic illustrations showing the privacy panel utilized within the desk system of the present invention.
Figure 16B:
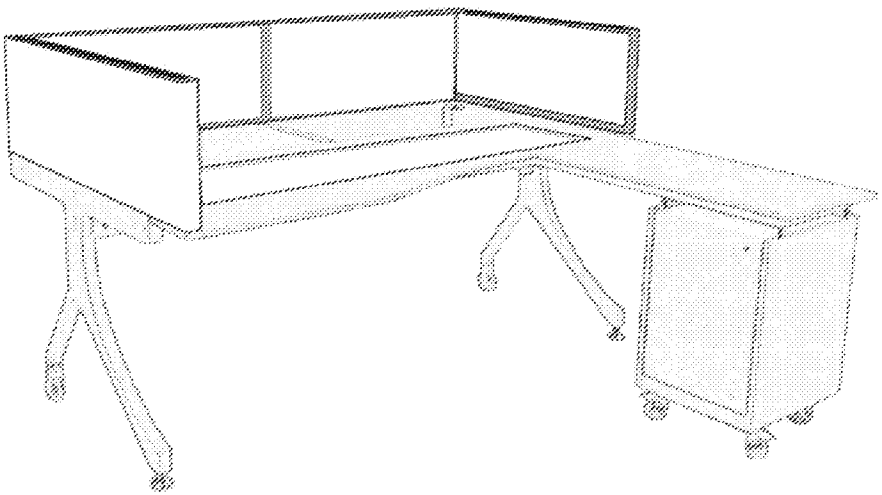

When employed with a desk system, such as the desk system of the present invention as described herein, multiple privacy panels 50 are coupled to and extend from the rear and side edges of the desk top. FIG. 16A schematically illustrates when all of the panel extensions 54 are being utilized in the manner described above. FIG. 16B schematically illustrates when the panel extensions are contained within the panel members.

Space Efficiency

As discussed above, accessible and usable volumetric space remains constant at any given instant in time, independent of whether storage 40 is open or closed. Moreover, and in accordance with the present invention, the combination of storage 40 and desk 12 as described herein advantageously increases the amount of overall usable volume and overall usable surface area without increasing the footprint of the desk system of the present invention. In particular, the inclusion of storage 40 and/or display pool 20 within the desk system of the present invention, as described herein, provides for a desk system that has substantially more overall usable volume and overall usable surface area as compared to traditional desks having a comparable footprint. For such traditional desks, in order to increase the amount of usable surface area, the size of the footprint would need to be enlarged. Further, in order to increase the amount of usable volume, the traditional desk may have to be supplemented with a traditional file cabinet. FIG. 1 shows an exemplary traditional file cabinet 48 that includes drawers that open up horizontally toward the desk user. However, the inclusion of such a traditional file cabinet disadvantageously increases the amount of floor space needed to accommodate such a system. Moreover, and although the file cabinet may be placed beneath the desk or incorporated into it, the file cabinet's drawers when open detrimentally interfere with the desk user and/or obstruct walking space and/or provide an unattractive obstacle to movement. Because of such undesirable features of an open file cabinet, the desk user and other people generally immediately close the file cabinet after accessing or placing contents within it. The present invention, on the other hand, provides for both increased volumetric storage space and usable surface area that entails none of the foregoing disadvantages of traditional desk systems.

Figure 17C:
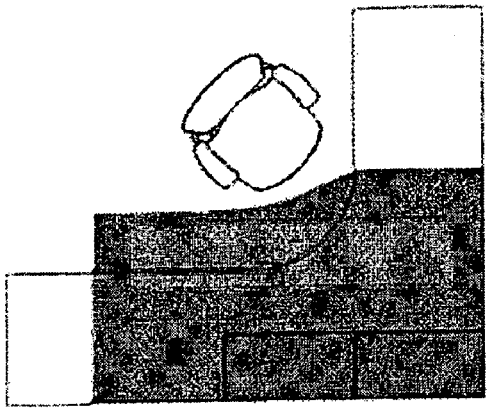
FIG. 17C shows the footprints shown in FIGS. 17A and 17B superimposed over one another.
Figure 17B:
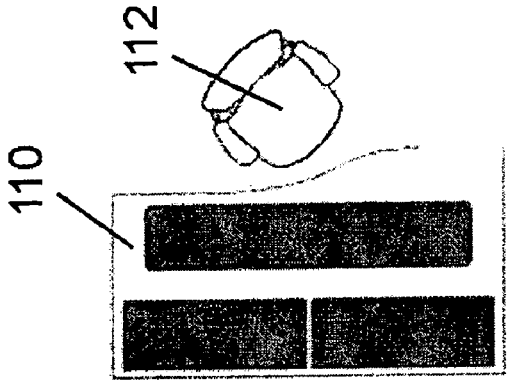
FIG. 17B shows a footprint of an exemplary desk system of the present invention.
Figure 17A:
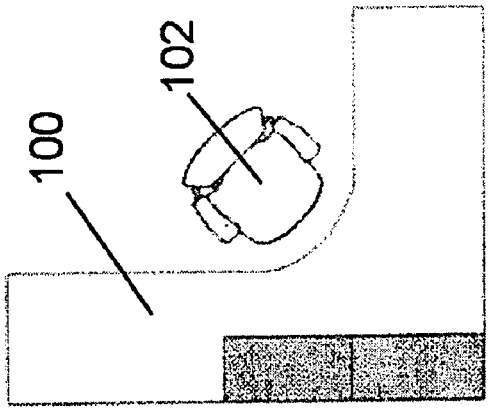
FIG 17A PRIOR ART
FIG. 17A shows a footprint of an exemplary traditional desk.

For comparison purposes, FIG. 17A shows the footprint of an exemplary traditional desk 100 (with a typical chair 102) having, for example, a desktop surface area of 28 square feet. Along with the space used by the chair (and typical chair movement/circulation), the total amount of floor space occupied (i.e., total plan area) is 56 square feet. The amount of volumetric space of the traditional desk 100 shown equates to approximately 2.5 cubic feet.

FIG. 17B shows the footprint of the desk system 110 of the present invention (with a typical chair 112). The desk system 110 has, as an example, a footprint (floor space usage) of 19.5 square feet and, together with chair 112 (including chair movement), a floor space usage of 39 square feet. In the example provided, desk system 110 of the present invention has a footprint (with and without a chair) that is smaller than that of the exemplary traditional desk 100.

For comparative purposes, FIG. 17C shows the footprints of traditional desk 100 and desk system 110 superimposed over one another.

In accordance with the present invention, while the footprint of desk system 110 of the present invention is smaller than the footprint of exemplary traditional desk 100, desk system 110 of the present invention has both a usable work surface area, that is, surface area accessible from a sitting position, and a usable volumetric space (including storage space), storage area accessible from a sitting position, that are greater than the amount of usable work surface area and usable volumetric space of traditional desk 100. In particular, desk system 110 has a usable work surface area of 34.5 square feet, which includes the surface area of each shelf of the vertically operable storage. If a display pool of the present invention having a surface area of 5 square feet is incorporated within desk system 110 of the present invention, desk system 110 has a usable work surface area of 39.5 square feet. Thus, while having a smaller footprint than the exemplary traditional desk 100, the desk system 110 of the present invention has a substantially larger work surface area (39.5 square feet) than the 28 square feet of work surface area of the traditional desk. Moreover, the volumetric space of desk system 110 is 5.5 cubic feet (with two vertically operable storage units), which is substantially more than the 2.5 cubic feet of volumetric storage of the exemplary traditional desk (including typical overhead storage in a traditional desk system). The table shown below sets forth these numbers to illustrate the space efficiency advantages of the desk system of the present invention

| | Traditional Desk 100 | Desk System 110 |
|---|---|---|
| Plan Area of Work Surface | 24.0 $ft^2$ | 19.5 $ft^2$ |
| Maximum Work Surface | 28.0 $ft^2$ (+/−) | 39.5 $ft^2$ |
| Total Plan Area (with chair circulation) | 56 $ft^2$ (+/−) | 39 $ft^2$ (+/−) |
| Storage Volume | 2.5 $ft^3$ | 5.5 $ft^3$ |

As indicated in the example provided above, the desk system of the present invention may have a footprint that is as much as 25% smaller than typical desk systems while having substantially more usable surface area and volumetric storage within the footprint than such typical desk systems.

Self-Contained Desk System

As previously described, desk 12 of the present invention includes a frame 16, which is a support structure for the primary work surface, and legs. Referring back to FIGS. 2, 3A and 3B, it is shown that most of the features of present invention, as described herein, are supported or extend from, in one way or another, the desk system's frame 16.

In a preferred version, desk 12 is fitted with two wheels 28, each attached to a different rear leg of the desk. Accordingly, the entire desk system of the present invention easily may be moved from one location, for example, in an office, to another location. However, in traditional desk systems, the system must be taken apart to enable it to be moved. In such traditional systems, various panels and compartments must be removed and moved to the new location and then reassembled. As would be appreciated, the construction of the desk system as herein described enables for convenient mobility.

Multi-Desk Configurations

As described herein, the desk system of the present invention includes a cable management system that employs a central spine for the supply and transfer of power and/or data. Left, right and central ribs, extending from the central spine, along with apertures therein, allow for the supply of power and/or data from a greater number of locations outside the desk (e.g., left rear, right rear, center rear, left center, right center, etc.) to the central spine and in turn to the electrical devices (e.g., computer, lamps, etc.) that may be used with the desk system of the present invention. Multiple desk systems of the present invention also may be employed in various configurations (also called "multi-desk configurations") and be aligned in various manners.

FIGS. 18A through 18H show various multi-desk configurations in accordance with the present invention. FIGS. 18A, 18E, 18F and 18G represent different configurations in the form of a train of back-to-back pairs of desks. Power and data are distributed between adjacently disposed desks directly via apertures at the ends of the central spines of those desks and power and data are distributed to a rear disposed desk via the channels within left and right ribs of the desks and the apertures at the rear ends of those ribs.

Figure 19:
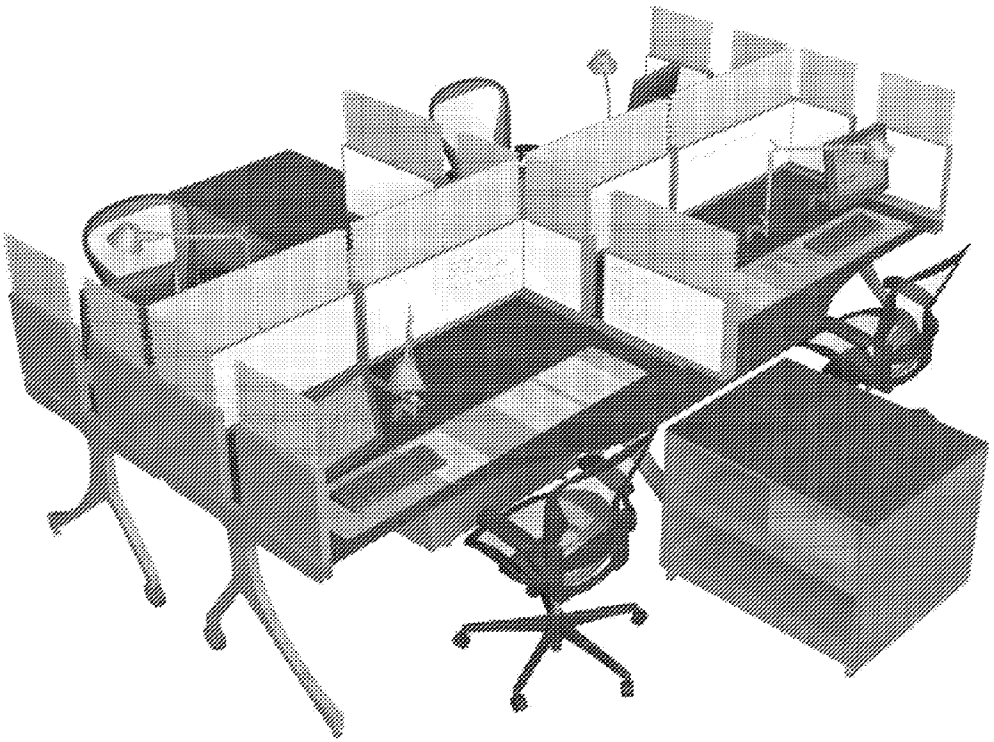
FIG. 19 illustrates the multi-desk system of the present invention in a particular configuration.

FIG. 19 illustrates a multi-desk system in one configuration, with various features of the present invention as previously described shown in the figure.

Figure 18D:
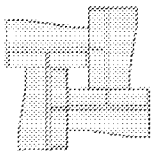
FIGS. 18A to 18H schematically illustrate various multi-desk configurations in accordance with the present invention.
Figure 18C:
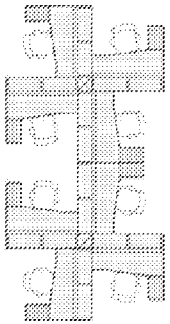
Figure 18B:
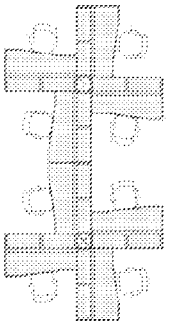
Figure 18A:
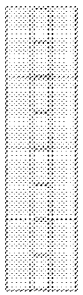

In accordance with the present invention, the configurations shown in FIGS. 18B, 18C and 18D represent different types of pinwheel type configurations. In each of these configurations, power and data are supplied between adjacent desk systems employing the use of one or more of the left, right and central ribs (see FIG. 5) for the transmission of power and data. In particular, FIG. 18D represents a desk configuration that entails the supply of power and/or data from one desk to an adjacent desk utilizing the central rib 68.

Figure 18H:
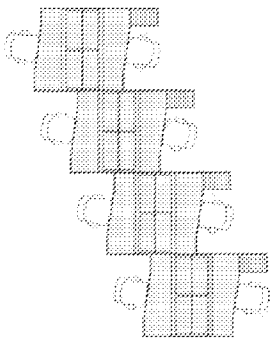
Figure 18G:
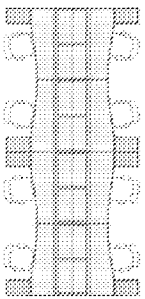
Figure 18F:
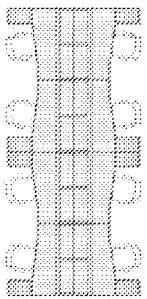
Figure 18E:
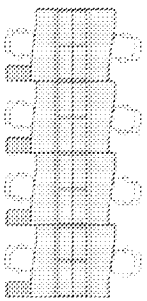

FIG. 18H represents a staggered configuration wherein power and/or data is transferred between adjacent desks in a variety of manners, employing one or more of the apertures 61 within the ends and center of the ribs shown in FIG. 5.

As is apparent from the foregoing discussion and the variety of desk configurations possible utilizing multiple desk systems in accordance with the present invention, the present invention provides for a greater flexibility of multi-desk configuration design than normally achieved with traditional desk systems. The cable management system of the present invention, as herein described, employing a central spine along with left, rear and center ribs, provides for substantial flexibility in multi-desk configurations.

In various multi-desk configurations, as represented in FIGS. 18A through 18H, various layouts additionally advantageously establish a clearer forward field of vision for users of the desks. In other words, due to the shape, size and configurations of the arrangements, each user's forward line of sight is not immediately interrupted by another user within the desk configuration.

The office furniture system of the present invention, as discussed above, provides various advantageous features and benefits. A "complete station" includes various components, such as the previously described display pool, vertically operable storage, privacy panels, tackable binder, accessory bracket, cable management system and other features described herein. A complete station may include some but not all of the features described herein. A complete station may include additional components not previously described. For example, the desk system of the present invention may include a rolling return having a two drawer pedestal, such as shown in FIG. 15. The desk system of the present invention may further include other well known features and storage.

In addition to a complete station having one or more of the features described herein, individually each of such features and components may be incorporated into different types of devices or items. For example, the above-described display pool may be incorporated into generic-type desks and other structures. As another example, the above-described vertically operable storage may be utilized with or incorporated into other structures, such as a standard or non-standard table, a standard or non-standard workbench or other apparatus. As yet a further example, the above-described privacy panels may be utilized with different types of desks, workstations, office cubbies, and other devices and/or units. Moreover, the above-described tackable binder, accessory bracket and cable management system, each individually may be utilized and/or employed in different types of desks and other devices. Thus, the present invention is not to be construed to be limited solely to an office furniture system employing all of the devices described herein.

In view of the foregoing discussion, it is intended that the appended claims be interpreted as including the embodiments described herein, the alternatives mentioned above, and all equivalents thereto.

What is claimed is:

1. A desk system, comprising:

a primary work surface;

a plurality of legs supporting the primary work surface; and a storage system including:

an outer cabinet and an inner storage structure, the inner storage structure having a storage area adapted to contain items for storage and an upper surface, the inner storage structure being vertically movable between a closed position within the outer cabinet and an open position disposed above the outer cabinet;

the inner storage structure, when moved to its closed position, positioning its upper surface substantially adjacent to a to surface of the primary work surface so that a user of the desk system is provided with a substantially continuous work surface by the primary work surface together with the upper surface of the inner storage structure, the inner storage structure being substantially fully contained within the outer cabinet when in the closed position, the storage area being inaccessible by a user when in the closed position;

the storage area being accessible by a user to access items stored within the storage area when the inner storage structure is in the open position;

the primary work surface including front and rear sections, and each of the rear section of the primary work surface and the storage system have a width substantially approximately half of a width of the front section, the rear section being disposed behind one of a right side and a left side of the front section, and the storage system being disposed behind the other of the right side and the left side of the front section.

2. The desk system of claim 1, wherein the top surface of the storage system when in the closed position is substantially flush with a top surface of the rear section of the primary work surface.

3. The desk system of claim 1, wherein an amount of volumetric space accessible to a user of the desk system when the storage system is in the closed position is substantially the same as an amount of volumetric space accessible to the user of the desk system when the storage system is in the open position.

4. A desk system, comprising:

a primary work surface;

a plurality of legs supporting the primary work surface;

a storage system including:

an outer cabinet and an inner storage structure, the inner storage structure having a storage area adapted to contain items for storage and an upper surface, the inner storage structure being vertically movable between a closed position within the outer cabinet and an open position disposed above the outer cabinet;

the inner storage structure, when moved to its closed position, positioning its upper surface substantially adjacent to a to surface of the primary work surface so that a user of the desk system is provided with a substantially continuous work surface by the primary work surface together with the upper surface of the inner storage structure, the inner storage structure being substantially fully contained within the outer cabinet when in the closed position, the storage area being inaccessible by a user when in the closed position;

the storage area being accessible by a user to access items stored within the storage area when the inner storage structure is in the open position; and a frame supporting the primary work surface, the outer cabinet of the storage system being fixed to the frame.

5. The desk system of claim 4, wherein the top surface of the storage system when in the closed position is substantially flush with the top surface of the primary work surface.

6. The desk system of claim 4, wherein an amount of volumetric space accessible to a user of the desk system when the storage system is in the closed position is substantially the same as an amount of volumetric space accessible to the user of the desk system when the storage system is in the open position.

* * * * *